US007810581B2

(12) United States Patent
Matsumoto et al.

(10) Patent No.: US 7,810,581 B2
(45) Date of Patent: Oct. 12, 2010

(54) BLADE APPARATUS FOR WORK MACHINE AND WORK MACHINE HAVING THE SAME

(75) Inventors: Norihisa Matsumoto, Osaka (JP); Tatsuo Wada, Osaka (JP)

(73) Assignee: Komatsu Ltd., Tokyo (JP)

( * ) Notice: Subject to any disclaimer, the term of this patent is extended or adjusted under 35 U.S.C. 154(b) by 667 days.

(21) Appl. No.: 11/072,966

(22) Filed: Mar. 3, 2005

(65) Prior Publication Data

US 2009/0321097 A1 Dec. 31, 2009

(30) Foreign Application Priority Data

Dec. 2, 2004 (JP) ..... 2004-350129

(51) Int. Cl.
*E02F 3/76* (2006.01)
*E01H 5/06* (2006.01)

(52) U.S. Cl. ..... 172/811; 37/266

(58) Field of Classification Search ..... 172/811, 172/810, 815, 818–828; 37/214–218, 253, 37/212, 266–285

See application file for complete search history.

(56) References Cited

U.S. PATENT DOCUMENTS

| | | | | |
|---|---|---|---|---|
| 3,974,882 | A | 8/1976 | Eftefield | 172/803 |
| 5,620,053 | A | 4/1997 | Kamikawa et al. | 172/4 |
| 5,799,737 | A | 9/1998 | Kamikawa et al. | 172/2 |
| 2005/0098332 | A1 | 5/2005 | Matsumoto | |

FOREIGN PATENT DOCUMENTS

| | | |
|---|---|---|
| JP | 4-92064 | 8/1992 |
| JP | 07-252859 | 10/1995 |
| JP | 2757135 | 3/1998 |
| WO | WO 2004/044337 | 5/2004 |
| WO | WO2004044337 A1 | 5/2004 |

OTHER PUBLICATIONS

European Search Report dated Feb. 8, 2008, Application No. FR 0502266 FA 676345 (2 pages).

*Primary Examiner*—Christopher J. Novosad
(74) *Attorney, Agent, or Firm*—Fish & Richardson P.C.

(57) ABSTRACT

The blade apparatus includes a connection blade portion which is provided at its lower end with a central blade portion including a straight first cutting edge and having a second cutting edge which extends continuously with the first cutting edge through a predetermined angle rearwardly, and an end blade portion having a third cutting edge which extends continuously with a second cutting edge through a predetermined angle forwardly, wherein front surfaces of the blade portions are concave curved surfaces which are continuous from the upper end to the lower end, across line between the connection blade portion and the end blade portion and a cross point between the second cutting edge and the third cutting edge are located rearward of the cross point of the first cutting edge and the cross line between the central blade portion and the connection blade portion, and at least a central main region of the central blade portion is made of steel plate, and at least the connection blade portion and the end blade portion are integrally cast together with a back surface support portion and first and second brackets thereof.

15 Claims, 17 Drawing Sheets

BLADE APPARATUS FOR WORK MACHINE AND WORK MACHINE HAVING THE SAME

BACKGROUND OF THE INVENTION

1. Field of the Invention

The present invention relates to a blade mounted on various work machines such as a bulldozer and a tractor shovel, and more particularly, to a compact blade apparatus of a work machine and a work machine including the blade apparatus, the blade apparatus being suitable for operation such as digging, transporting and leveling, and having excellent assembling performance, workability, fuel economy and cost efficiency.

2. Description of the Related Art

In various workplaces such as construction workplace and civil engineering workplace, various work machines such as a bulldozer and a tractor shovel are used heavily. On the work machine of this kind, a blade which is a work implement is mounted. This blade is widely used for dozer operation such as digging, transporting, piling, compaction and leveling.

To fully exploit the best operation efficiency in this work machine, it is important to increase the amount of transported soil per one cycle as much as possible, to reduce resistance caused during digging and transporting as small as possible, and to satisfy various conditions such as compatibility between various soil characteristics. If the work machine can also carry out the piling, compaction and leveling, it is preferable because the operation efficiency is remarkably enhanced. If the optimal structure, shape, width and height of the blade as well as position of a cutting edge and digging angle which satisfy these conditions can be found, there are merits that the operation efficiency of the work machine is enhanced, the fuel consumption is reduced, and the entire work period can be shortened. When the optimal structure and the like are found, it is also necessary that the blade can be produced easily and inexpensively.

Japanese Patent No. 2757135 (patent document 1) discloses one example of the blade for increasing workload of the work machine of this kind. According to this publication, when soil is to be transported, an attitude of the blade provided on a large bulldozer is pitched back through a predetermined angle with respect to an attitude of the blade at the time of digging by a blade control apparatus, thereby increasing an amount of soil held in the blade, and when soil is to be discharged, the attitude of the blade is pitched dump through a predetermined angle with respect to the attitude of the blade at the time of digging so that soil discharging operation is facilitated.

To fully exploit the operation efficiency of a bulldozer, a balance between forces in the transporting operation of the bulldozer must be set such that tractional force is greater than transporting resistance and driving force of the vehicle is greater than the tractional force. In the bulldozer of the patent document 1, the tractional force is increased and the transporting resistance is reduced and the workload of the bulldozer is increased by controlling the attitude of the blade, as described above. Nevertheless, it makes it possible to largely increase the transporting amount without increasing the bulldozer in size, increasing the engine output or increasing the capacity of the blade.

Most of the engine output required when the bulldozer carries out digging and transporting operations is consumed for the driving force of the vehicle and the tractional force when the digging and transporting operations are carried out. Therefore, it is also necessary to reduce the loss of energy amount during power transmission and to enhance the fuel consumption efficiency. If these requirements are satisfied, it becomes possible to effectively use the engine output during the digging and transporting even if the blade has the same capacity as that of the conventional technique and the tractional force is the same as that of the conventional technique.

The present applicant proposed a totally new blade structure for satisfying the above requirements in WO2004-044337A1 (patent document 2).

The blade disclosed in this patent document 2 includes a central front surface portion, and a connecting front surface portion and an end front surface portion which are bent and continuously provided on each of right and left ends of the central front surface portion in succession. The central front surface portion has a blade width whose lower end intersects a digging direction and extends in the lateral direction, and is provided at a further lower end of said lower end with a first cutting edge. The connecting front surface portion is disposed on each of the right and left ends of the central front surface portion, and is provided at a lower end of the connecting front surface portion with a second cutting edge. The end front surface portion is continuously provided on the connecting portion, and is provided at a lower end of the end front surface portion with a third cutting edge. A cross line between the connecting front surface portion and the end front surface portion and a cross point between blade edges of the second cutting edge and the third cutting edge are located on a retreat position retreated from the blade edge of the first cutting edge as viewed from above. Front surfaces of the central front surface portion, the connecting front surface portion and the end front surface portion have special shapes formed in a concavely curved surface which is continuous from an upper end to a lower end.

A construction machine and an earthmoving machine are included as a work machine to which the blade of the patent document 2 is applied. Typical examples of the construction machine and the earthmoving machine include a construction vehicle and an earthmoving vehicle such as a bulldozer, a backhoe and a motor grader. The terms "as viewed from front" and "as viewed from above" of the blade of the present invention are used in this specification based on the condition that the blade is put on the earth's surface at an digging angle of highest digging efficiency.

The blade of the patent document 2 is the same as a conventional blade in that the blade includes a central front surface portion constituting a portion of a blade front surface, and right and left end front surface portions expanding such as to open forward at right and left side ends of the blade. However, the blade of the patent document 2 is largely different from the conventional blade in that the right and left end front surface portions extend through right and left connecting front surface portions which are continuously disposed from the right and left ends of the central front surface portion such as to open rearward, and front surface portions of all of the central front surface portion, the connecting front surface portion and the end front surface portion are curved in a concave manner from the upper end to the lower end.

In the entire blade, its first cutting edge positively cuts earth and sand substantially earlier than the third cutting edge of the end front surface portion. Therefore, digging force of the third cutting edge of the end front surface portion is smaller than that of the conventional blade end. Thus, as compared with the conventional blade, the tractional force applied to the cutting edge of the end front surface portion is moderated, resistance force such as digging resistance and transporting resistance are transmitted to the first cutting edge and the third cutting edge of the end front surface portion substantially uniformly.

In the case of the blade of the patent document 2, the tractional force is effectively applied to both the first cutting edge and the cutting edge of the end front surface portion, soil cut by the third cutting edge of the end front surface portion and soil cut by the first cutting edge of the central front surface portion smoothly merge with each other. As a result, as compared with the conventional blade provided at right and left portions of its blade body with blade plates, the resistance force is largely reduced, and the amount of soil per tractional force can largely be increased. Further, consumed horsepower during digging and transporting can largely be reduced, it is possible to obtain the maximum digging and transporting amounts within short time and with minimum energy amount, the fuel economy efficiency of the work machine is remarkably enhanced, and cost per earthwork amount can be reduced.

The outward appearance shape of soil when soil is pushed by the blade of the patent document 2 is such that the central front surface portion is largely swelled forward from its upper end toward its lower end, and its central portion exceeds the angle of repose. On the other hand, in the case of the conventional blade, the outward appearance shape of the soil is such that the blade is straight and flat surface shape having an inclination angle that is substantially equal to the angle of repose from the upper end toward the lower end of the blade.

The resistance is reduced by the synergism, and the amount of soil per tractional force can largely be increased. Further, the consumed horsepower during digging and transporting can largely be reduced, it is possible to obtain the maximum digging and transporting amounts within short time and with minimum energy amount, the fuel economy efficiency of the work machine is remarkably enhanced, and cost per earthwork amount can be reduced.

The second cutting edge and the third cutting edge are continuous with each other in a V-shape or U-shape. Especially when cohesion of soil is high, if the second cutting edge and the third cutting edge are connected to each other in the V-shape, the excavated soil is attached to a switching portion between the connecting front surface portion and the end front surface portion and agglomerated in many cases. Therefore, it is preferable that the switching portion is curved into U-shape. Further, blade front surfaces of the central front surface portion, the connecting front surface portion and the end front surface portion are vertically continuously curved surfaces, and these curved surfaces are concave surfaces having the same curvature. If the surfaces are formed into the curved surfaces in this manner, a large amount of soil can be carried on the blade front surface of the respective front surface portions, excellent balance of ground pressure in the front and rear portions of the vehicle body can be obtained, power loss such as shoe slip is small, and high tractional force can be obtained. It is also possible to prevent soil accumulated on the blade front surface of the respective front surface portions of the blade from exceeding the upper ends of the respective front surface portions and from overflowing rearward.

Since the blade is prone to be large in size and heavy in weight, a sheet metal is generally used for the blade. If the blade is large in size, its weight is increased of course, but even if the blade is small in size, the blade is relatively large unlike normal parts and thus, its weight is apt to be heavy. Therefore, it is impossible to obtain a desired shape simultaneously from one sheet metal using a pressing machine. Thus, a plurality of divided plates divided along bending switch lines of the blade are produced, the divided plates are welded along the bending switch lines of the blade, and a blade having a desired shape is assembled. The welding operation is not difficult when the weld line of the divided plate is a simple straight line, but when the shape of the weld line is complicated or curved, it is difficult to precisely weld even for a skilled welder, producing costs including labor costs is increased, and producing time is increased. As a result, the cost of the product is increased, and deliveries are delayed.

The blade proposed in the patent document 2 has various excellent effects which can not be expected in the conventional blade, but its shape is complicated, and if the attitude of the cutting edge at the time of digging and transporting is taken into consideration and if the welding operation is carried out by a welding robot, high performance motion of the robot is required. Thus, it is necessary to sufficiently study in terms of hardware and software, and it is impossible to develop ideal welding operation at an early stage. It is impossible even for skilled welder to easily carry out high precision welding operation within short time. It is found that the welding strength becomes lower than normal material strength having small thermal hysteresis. To compensate this, welding technique with high precision is required. Since the excavated soil merges with a portion of the bending switch line, if a weld line having inferior wear resistance is used for the bending switch line, there is a possibility that patch-up welding is required relatively within short time.

Generally, main operations of the work machine are digging, transporting and leveling, and it is extremely effective for the work machine to have function capable of carrying out these operations with the same blade because the equipment cost can be reduced. The blade described in the patent document 2 has function of digging, transporting and leveling.

Usually, for the leveling operation of this kind, two points are required, i.e., to flatten the ground while excavating the ground and carry the soil forward and fill in holes during the former operations, and to uniformly level the ground. In the patent document 2, if the blade width of the central front surface portion is increased, the so-called leveling function is enhanced. In the invention, the connecting front surface portion is opened and extended from the central front surface portion rearward as viewed from above, and the end front surface portion is forwardly opened from the right or left connecting front surface portion. Here, although the connecting front surface portion and the end front surface portion also have the leveling function, most of this function relies on the central front surface portion. In the patent document 2 also, it is possible to increase the blade width of the central front surface portion.

In the patent document 2, however, it is also important that soil cut by the cutting edge of the end front surface portion and soil cut by the first cutting edge smoothly merge with each other to largely increase the transporting amount. Therefore, in the patent document 2, as the blade width of the central front surface portion is increased, it becomes necessary to narrow the width of the connecting front surface portion and the end front surface portion as viewed from above.

In order to narrow the width of the connecting front surface portion and the end front surface portion, to reduce resistance force such as digging resistance and transporting resistance, and to largely increase the transporting amount, it is preferable that the length along lower ends of the connecting front surface portion and the end front surface portion is fixed. That is, in order to widen the blade width of the central front surface portion and to secure the necessary length along the lower ends of the connecting front surface portion and the end front surface portion, it is necessary to reduce the bending angle between the connecting front surface portion and the end front surface portion with respect to the digging direction of the central front surface portion as viewed from above. As a result, it naturally becomes necessary to increase the distance between the cutting edge position of the central front surface portion and a supporting point of a lift frame which supports the blade.

If the distance between the cutting edge position of the central front surface portion and the supporting point of the lift frame which supports the blade is increased, an influence of uneven spots on the ground at the time of digging is largely exerted, pitching motion of the vehicle is prone to be generated in the longitudinal direction. As a result, the blade largely swings vertically, stable digging can not be carried out by the central front surface portion, the excavated surface is prone to be uneven, and the ground can not be uniformly flattened. If these factors are taken into consideration, it is necessary to determine the blade width of the central front surface portion while taking the blade widths of the connecting front surface portion and the end front surface portion into consideration. In this invention, the blade width of the central front surface portion is set substantially equal to a gage width which is a distance between centers of right and left running apparatuses, thereby increasing the effective digging force per blade width of the first cutting edge of the central front surface portion, effective digging and transporting can be carried out and it is possible to uniformly level the ground.

SUMMARY OF THE INVENTION

The present invention has been accomplished in view of the above circumstances and after hard research, and in various blade apparatuses for various work machines proposed in the patent document 2, especially in various blades for earthmoving machines and construction machines to which high load is applied under severe environment, it is an object of the invention to provide a blade apparatus for a work machine capable of easily obtaining a desired shape which is short in its longitudinal direction, capable of securing desired rigidity and strength although its weight is light, capable of easily forming a smooth curved surface that can not be obtained by welding, and capable of sufficiently exhibiting various functions as a blade described in the patent document 2.

The object is effectively achieved by the following blade apparatus. That is, the blade apparatus comprises a central blade portion, and a connecting blade portion and an end blade portion which are bent and continuously provided on right and left ends of the central front surface portion in succession, wherein the central front surface portion has a blade width whose lower end intersects with a digging direction and extends laterally, and is provided at its lower end with a first cutting edge, the connecting front surface portion is disposed on right and left ends of the central front surface portion and is provided at its lower end with a second cutting edge, the end front surface portion is continuously formed on the connecting portion and is provided at its lower end with a third cutting edge, a cross line between the connecting front surface portion and the end front surface portion and a cross point between blade edges of the second cutting edge and the third cutting edge are located on retreat positions rearward of a blade edge of the first cutting edge as viewed from above, front surfaces of the central front surface portion, the connecting front surface portion and the end front surface portion include a central blade portion and an end blade portion which is continuously formed on right and left ends of the central blade portion through a connection blade portion, and the blade comprises a pair of right and left integral castings which include all of the connection blade portion and the end blade portion, and include a connection end surface with respect to a connection side end surface of the central blade portion, and a sheet metal portion including a main region of at least the central blade portion, and a connection end surface connected to the connection end surface of the integral casting.

When the central blade portion is on a vertical line as viewed from front and connection end of the central blade portions connected to right and left ends thereof is also on a vertical straight line, all of the central blade portions may comprise sheet metal portions, the connection blade portion and the end blade portion may comprise integral casting, and the sheet metal of the central blade portion, the connection blade portion and the integral casting comprising the end blade portion may be integrally formed by welding.

However, when the central blade portion has, for example, a reversed-trapezoidal shape and the connection blade portion is formed into a thin and long trapezoidal or triangular shape so as to compensate the central blade portion and front surfaces thereof have such complicated shapes that the front surfaces are concave arc surface having the same curvature from upper end toward lower end thereof, both ends of the central blade portion except the main region are divided straightly, the divided ends are integrally cast together with the connection blade portion and the end blade portion to form the integral castings, and the main region of the central blade portion made of sheet metal and the divided ends of the central blade portion of the integral casting are preferably integrally coupled to each other by welding. That is, it is preferable that the integral castings include the connection side ends of the central blade portion.

To ensure the blade strength and to minimize the capacity, it is preferable that the bracket through which right and left arm ends and a rod end of the hydraulic cylinder are pivotally supported is integrally cast together with a bracket mounting portion of the integral casting back surface. At that time, a portion of the back surface support portion casting the bracket and this bracket are formed into a continuous solid structure, and the other back surface support portion is formed into a hollow structure. It is preferable that the integral casting is continuously provided on the back surface of the sheet metal portion, and the back surface support member which is flush with the back surface of the integral casting is provided. It is preferable that a hollow structure in which a plurality of reinforcing ribs are provided is formed between at least a portion of the sheet metal portion and at least a portion of the back surface support member. It is preferable that at least a portion of the back surface support member and the ribs are formed as an integral casting.

As described above, it is preferable that blade portion front surfaces of the central blade portion, the connection blade portion and the end blade portion are vertically continuous concave curved surfaces having the same curvature. Further, it is preferable that the central blade portion, the connection blade portion and the end blade portion are continuously formed into V-shape or U-shape.

The blade having such a structure can suitably mounted on various work machines, such as a bulldozer, a backhoe and a motor grader which are representative construction machine and earthmoving machine.

The blade apparatus for the work machine disclosed in the patent document 2 which is a subject of the present invention originally has complicated shape and structure as described above. Therefore, it is extremely difficult to weld divided plates comprising the central front surface portion, the connecting front surface portion and the end front surface portion in succession, and as the shape is more complicated, it becomes difficult to secure the required welding strength. Further, the right and left connecting front surface portions of the blade front surface portion extend such that they open rearwardly from right and left ends of the central front surface portion, and the end front surface portion extends such that the end front surface portion is folded back forward and open from each connecting front surface portion. Due to the shape of the blade front surface portion, in order to secure the rigidity and strength of the blade by integrally forming the cylindrical back surface support member which is the support member with the back surface of the blade front surface portion, it is necessary to interpose the necessary number of reinforcing ribs between the back surface support member and each of the central blade portion, the connection blade portion and the end blade portion.

At the final assembling stage, the reinforcing ribs also must be integrally fixed between the back surface support member and each of the central blade portion, the connection blade portion and the end blade portion by welding. The sheet metal is a box-like structure whose front portion is opened. A large number of reinforcing ribs are disposed in a space between the back surface support member and each of the central blade portion, the connection blade portion and the end blade portion each. Therefore, it takes long time to weld the reinforcing ribs. Further, in the case of the blade having peculiar shape provided at its front and rear portions with bent spaces, the shapes of the reinforcing ribs are not uniform, costs for producing the ribs and for welding them are increased, and this increases the cost.

The bent switching region between the connecting front surface portion and the end front surface portion where a distance between the blade and the back surface support member is the shortest as viewed from above is a region where the highest load is received. Thus, it is necessary to secure sufficient rigidity and strength. To satisfy this, reinforcing ribs are required also in the bent switching region, and the rib also requires longitudinal length of some degrees. For this reason, the entire back surface support member must retreat from the front surface portion of the blade largely. The back surface of the back surface support member increases the maximum longitudinal length of the blade apparatus itself, and the entire blade apparatus is increased in size.

In order to assemble the blade apparatus disclosed in the patent document 2 by the conventional technique and to secure desired rigidity and strength, a new technique apart from the conventional technique is required taking it into consideration the fact that the blade apparatus is forced to be increased in size and weight, the above-described required welding strength is not easily obtained, the blade front surface portion is curved in the vertical direction, and since the blade is bent in the widthwise direction into V-shape or U-shape, soil retaining is prone to be generated and the welding portion must be finished. As a result of further research, the inventors reached a conclusion that a region having the bent surface including at least the connecting front surface portion and the end front surface portion where the distance between the blade front surface portion and the back surface support member is the shortest and shape variation is the greatest is integrally cast together with the back surface support member, at least the central main region of the central blade portion where the distance between the blade front surface portion and the back surface support member is the greatest and the shape variation is the smallest is made of sheet metal and this is the best measure for solving the above problems related to production.

That is, in the present invention, the sheet metal portion and the integral casting are separately produced, a portion of the blade front surface portion is integrally cast together with the back surface support portion, necessary rigidity and strength are secured with the minimum necessary depth, the back surface support member mainly made of sheet metal is disposed on the sheet metal portion, and the back surface support member integrally cast with the reinforcing ribs is disposed on a portion of the back surface support member. Since such a structure is employed, smooth surface can be obtained in the curved portion and the bent portion, and it is possible to obtain the blade apparatus having necessary rigidity and strength and necessary minimum capacity and weight. The welding portion where the central blade portion and the connection blade portion are welded can be formed straightly as viewed from front and thus, robot welding can easily be applied, producing cost can be reduced and producing time can largely be reduced.

As described above, the blade apparatus of the present invention has a peculiar shape having the bent surface and curved surface, and the blade apparatus obtains an integral casting including all of the bent regions, and the curved plate made of sheet metal having constant curvature is used only for the main region of the central blade portion. For example, when both right and left ends of the central blade portion have width shapes which are reduced downward, the boundary line between the connection blade portion and the right and left ends including the back surface support portion is naturally curved in the vertical direction and the lateral width is gradually reduced downward. Therefore, it is the wise policy to avoid the welding at this boundary line region. In the present invention, when the blade has the above described shape, the boundary line between the sheet metal portion and the integral casting is formed into the vertically straight line shape as viewed from front and thus, both ends laterally extending from the upper end edge of the central blade portion are divided into three portions along the vertical line, the divided end is shifted to the integral casting, the divided end is integrally cast together with the connection blade portion and the end blade portion, thereby forming the integral castings. With this, the central main region of the central blade portion becomes rectangular shape as viewed from front, the sheet metal can easily be bent, and it is easy to weld the butted end surfaces between the main region and the divided end of the integral casting.

Further, the back surface support portion of the integral casting is integrally cast together with the bracket through which ends such as right and left arms through which one end is pivotally supported by the body of the work machine and cylinder rod are pivotally supported. With this, it becomes unnecessary to weld the bracket on the back surface support member unlike the conventional technique, and necessary bracket strength can easily be obtained. At that time, a portion between the bracket and the back surface support portion on which the bracket is provided are cast as a solid structure, and the other back surface support portion is formed as a hollow structure. With this, necessary rigidity and strength can easily be secured, and weight can also be reduced.

DESCRIPTION OF THE PREFERRED EMBODIMENTS

Figure 1:
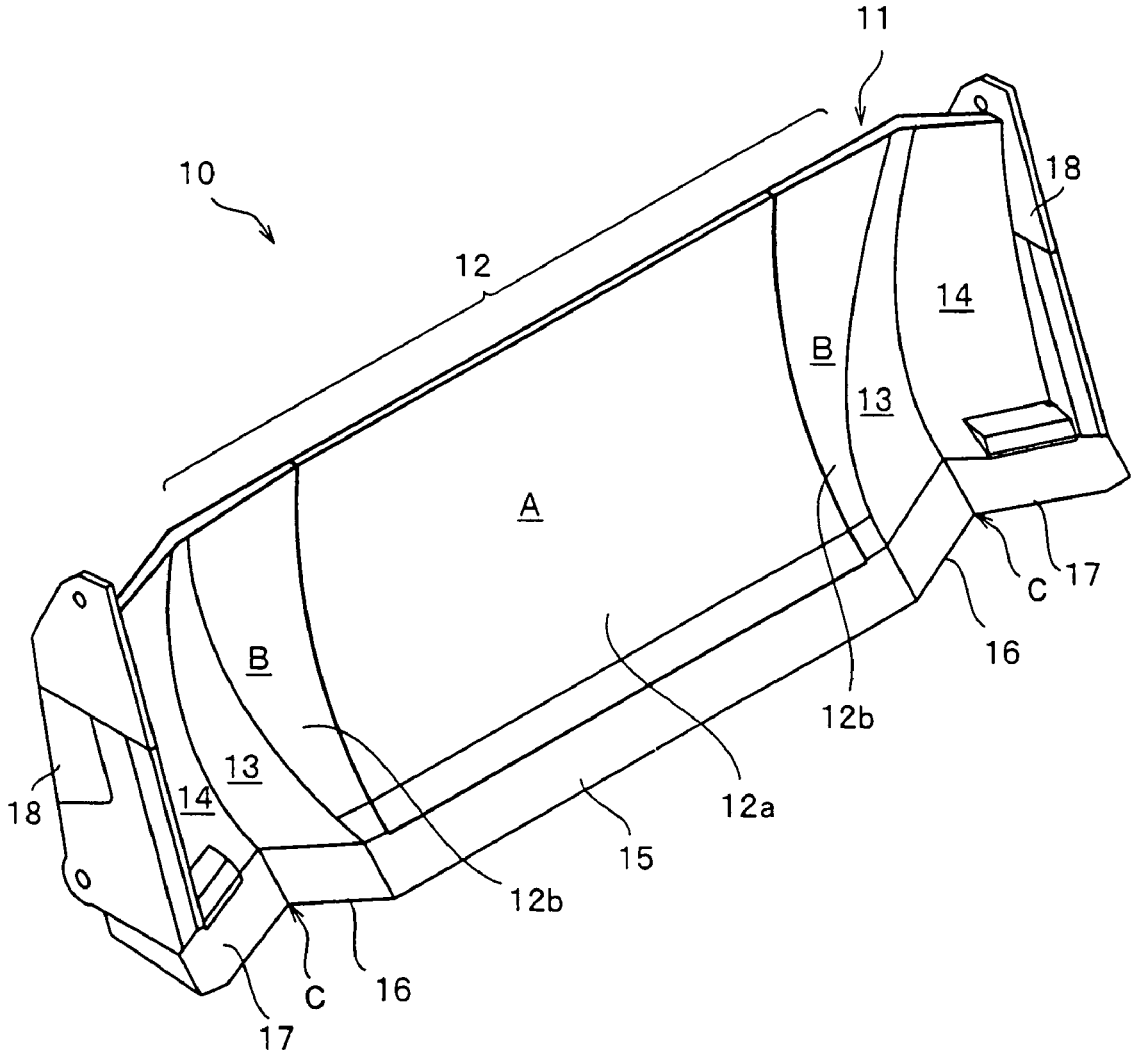
FIG. 1 is a perspective view showing an entire schematic structure of a typical blade apparatus applied to the present invention as viewed from front.

Preferred embodiments of the present invention will be explained concretely based on the attached drawings. A blade apparatus of this invention can be used as a work implement to be mounted on various work machines. Examples of the work machine applied to the present invention are a construction machine and an earthmoving machine. In this embodiment, a bulldozer (not shown) is described as examples of the construction machine and the earthmoving machine, but the invention is not limited to this. For example, a construction vehicle and an earthmoving machine vehicle such as shovel, backhoe and motor grader are included.

A front surface portion of the blade apparatus of this invention is based on a basic shape of the blade apparatus front surface portion disclosed in the patent document 2. Therefore, the concrete effect obtained based on this basic shape is the same as that described in the patent document 2. Thus, only outline of this effect will be explained briefly and effect which is particular to the present invention will be explained in detail. A blade 11 of the blade apparatus 10 of this invention has a basic structure shown in FIG. 1. That is, a front surface of the blade 11 is a curved surface which is vertically curved in the concave manner. The blade 11 comprises a central blade portion 12 provided at its lower end with a straight first cutting edge 15, a pair of right and left connection blade portions 13 having second cutting edges 16 which is opened and extended continuously from the first cutting edge 15 rearward through a predetermined angle, and a pair of right and left end blade portions 14 having straight third cutting edges 17 which is opened and extended continuously from the second cutting edge 16 forward through a predetermined angle.

Figure 5:
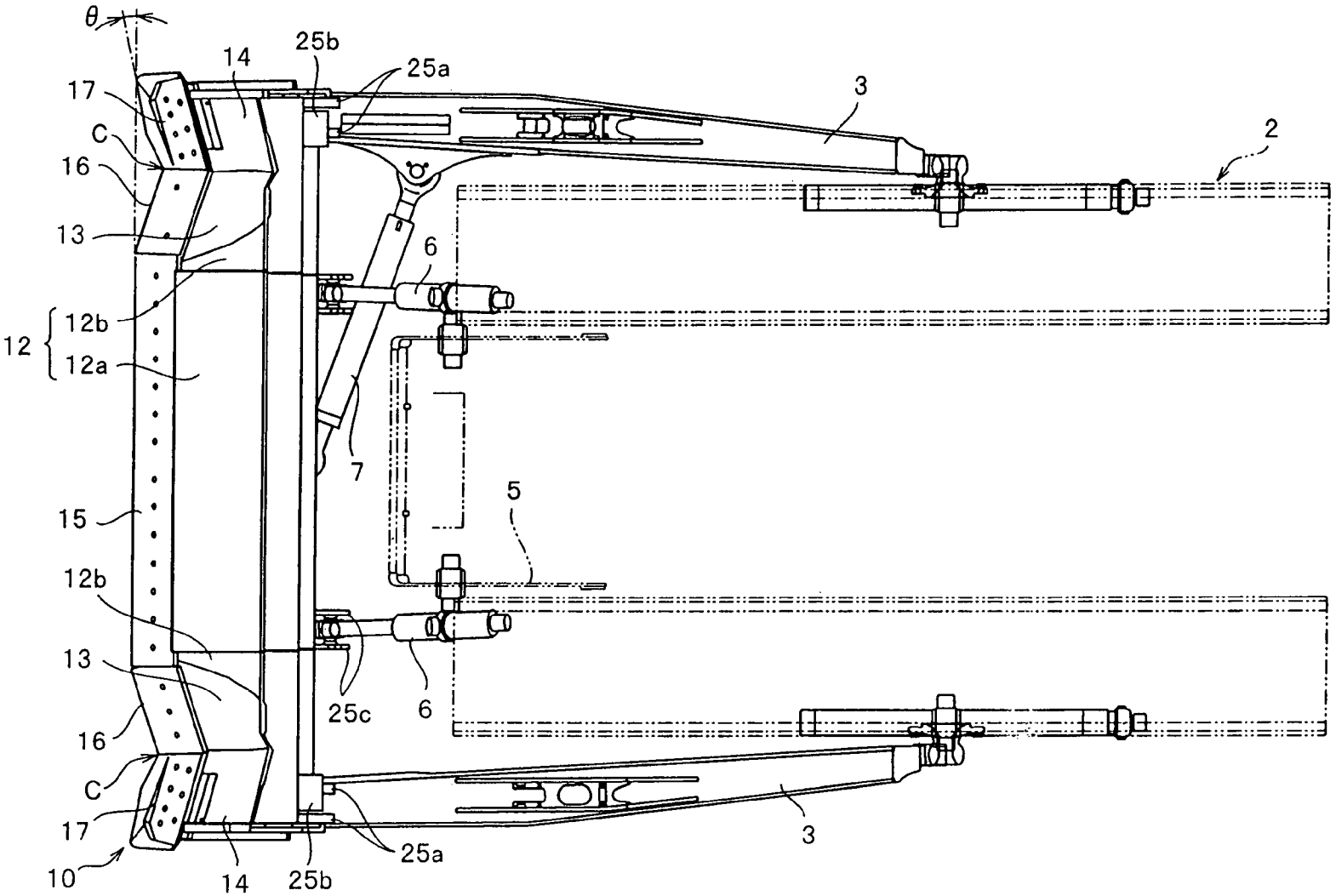
FIG. 5 is a top view showing an example of a structure of an essential portion of the work machine.

In the blade apparatus 10 of this invention, as shown in FIG. 5, a side line of the end blade portion 14 and a tip end of the third cutting edge 17 may be retreated from a side line of the central blade portion 12 and the first cutting edge 15, but they may forwardly project from a side edge of the central blade portion 12 and the first cutting edge 15. In brief, it is only necessary that the connection blade portion 13 is bent while opening continuously from the right and left side lines of the central blade portion 12, and the connection blade portion 13 is bent continuously from the outer side lines of the right and left connection blade portions 13 while opening forward. However, a cross line between the connection blade portion 13 and the end blade portion 14, and a cross point C between the second cutting edge 16 and the third cutting edge 17 must be at rearward positions from the right and left side lines of the central blade portion 12 and the first cutting edge 15.

The characteristic portion of the present invention that is different from the patent document 2 is that right and left end regions B of the central blade portion 12, the connection blade portion 13 and the end blade portion 14 of the invention are integrally cast including back surfaces, and that a central main region A of the central blade portion 12 is formed separately from the front surface plate 106 and a later-described back surface support member 107, and they are integrally formed by welding. At least the central main region of the front surface plate 106 of the central blade portion 12 is made of rolled steel plate, the back surface support member 107 corresponding to the front surface plate 106 is partially made of steel plate, and a casting designed specifically for the back surface support member cast separately from the integrally cast portion is used for a portion of the back surface support member 107 requiring strength.

All portions of the blade apparatus described in the patent document 2 having the peculiar shapes as described above are assembled by welding steel plate. To assemble the blade apparatus, the number of parts to be welded is extremely large, and extremely precise positioning and high welding technique are required due to their peculiar shapes. In the case of the blade apparatus described in the patent document 2, if the blade front surface portion and the steel plate of the back surface are merely be disposed side-by-side without providing a reinforcing rib on the bent boundary portion between the connecting front surface portion and the end front surface portion which is a region where the distance between the blade front surface portion and the steel plate of the back surface is shortest as viewed from above, rigidity and strength required for the bent boundary portion can not be secured. To avoid this, if the thickness thereof is increased to enhance the rigidity and strength of the steel plate itself, a weight thereof is adversely increased. If a reinforcing rib is provided on the bent boundary portion, the distance between the blade front surface portion and the support portion of the back surface must be increased, and the number of parts is further increased. As a result, the maximum length of the blade in its longitudinal direction is largely increased, and the blade is largely increased in size and weight.

Figure 2:
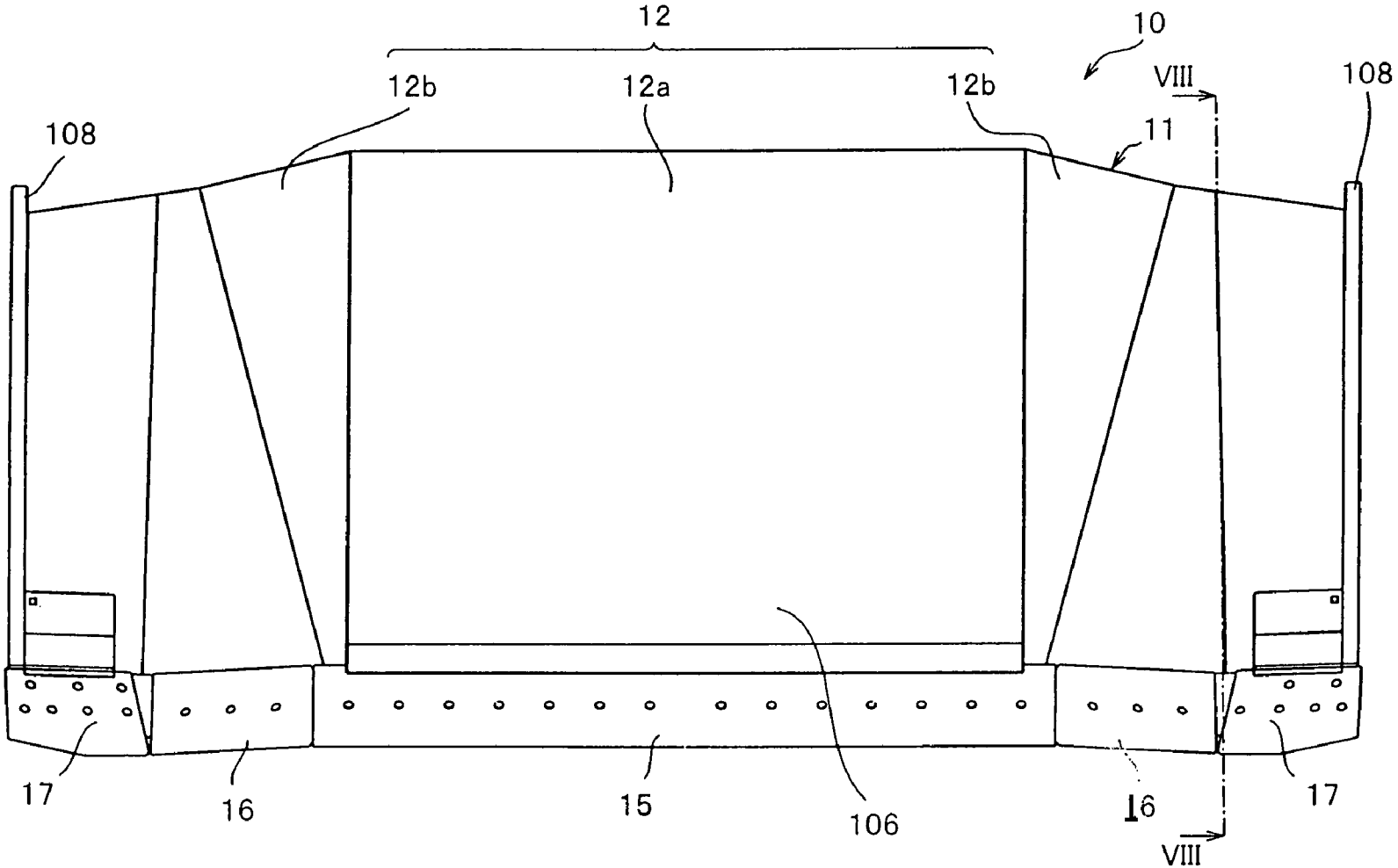
FIG. 2 is a front view of the blade apparatus.

In this embodiment, as shown in FIGS. 1 and 2, the central blade portion 12 has a substantially inverted-trapezoidal shape as viewed from front is divided into three portions, i.e., a rectangular divided central region 12*a* of the central main region A, and substantially triangular divided ends 12*b* which are right and left end regions B thereof. Each of the divided ends 12*b* is rearwardly opened into V-shape or U-shape through a predetermined angle, and connection blade portions 13 are connected to the divided ends 12*b*, the connection blade portions 13 are forwardly opened into V-shape or U-shape through a predetermined angle and end blade portions 14 are connected to the connection blade portions 13, respectively. At that time, front surfaces of the central blade portion 12, the connection blade portions 13 and the end blade portions 14 are curved in concave manner with the same curvature in the vertical direction.

In the present invention, as described above, the divided end 12*b*, the central blade portion 12 and the end blade portion 14 which form a bent surface and a curved surface on the front surface are integrally cast including the back surface support member 107, thereby forming the integral casting 101. A main constituent member of the rectangular divided central region 12*a* of the central blade portion 12 is formed of a steel plate portion 105 made of steel plate.

The central blade portion 12 includes the front surface plate 106 and the later-described back surface support member 107. The front surface plate 106 is of laterally long rectangular shape as viewed from front shown in FIG. 2. The front surface plate 106 is a central rectangular portion when the central blade portion 12 having the inverted-trapezoidal shape is cut from opposite ends of its upper bottom toward a lower bottom at right angles, i.e., a plate material constituting the front surface of the rectangular divided central region 12*a*. The opposite end inverted-triangular portion after cutting is integrally cast including the connection blade portion 13, the end blade portion 14 and the back surface support portion. In this specification, a region in the central blade portion 12 including the front surface plate 106 and the back surface support member 107 is called the steel plate portion 105, and a region which is integrally cast including a later-described back surface support portion 103 of the other blade portion excluding the steel plate portion 105 is called an integral casting 101. If the central blade portion 12 is divided into three portions, i.e., the rectangular divided central region 12*a* and the triangular divided ends 12*b* along the vertical line, the rectangular divided central region 12*a* and the front surface of the triangular divided ends 12*b* are formed on a smoothly continuous surface and at the same time, the coupling line is a straight line along the curved surface. Therefore, the welding operation in the assembling step can be carried out automatically by a welding robot without using man's hand.

The front surface of the connection blade portion 13 of this embodiment is formed into a substantially triangular or trapezoidal shape whose width is gradually increased from its upper portion to its lower portion unlike the central blade portion 12. As viewed from front in FIG. 2, a side line of the connection blade portion 13 is curved and extended in the same direction as the connection side end edge of the central blade portion 12. The front surface of the end blade portion 14 has the same width from its upper portion to its lower portion as viewed from front, and is formed into a vertically long substantially rectangular shape which is curved in the concave manner with the same curvature as those of the central blade portion 12 and the connection blade portion 13. The lower end of the central blade portion 12 projects forward from the tip end position of the end blade portion 14. The entire shape of the blade 11 is laterally long rectangular shape as viewed from front. The front surfaces of the blade portions 12, 13 and 14 are connected to each other in a V-shape which largely spreads in the horizontal direction as shown in FIG. 1. Although the drawing shows the V-shape, this shape is not limited to V-shape, and it may be U-shape whose opening end largely open. Here, the expression "as viewed from front" is based on a condition where the cutting edge is brought into contact with the ground such that the digging angle β with respect to the ground is set to the highest digging efficiency angle as shown in FIG. 4.

Figure 4:
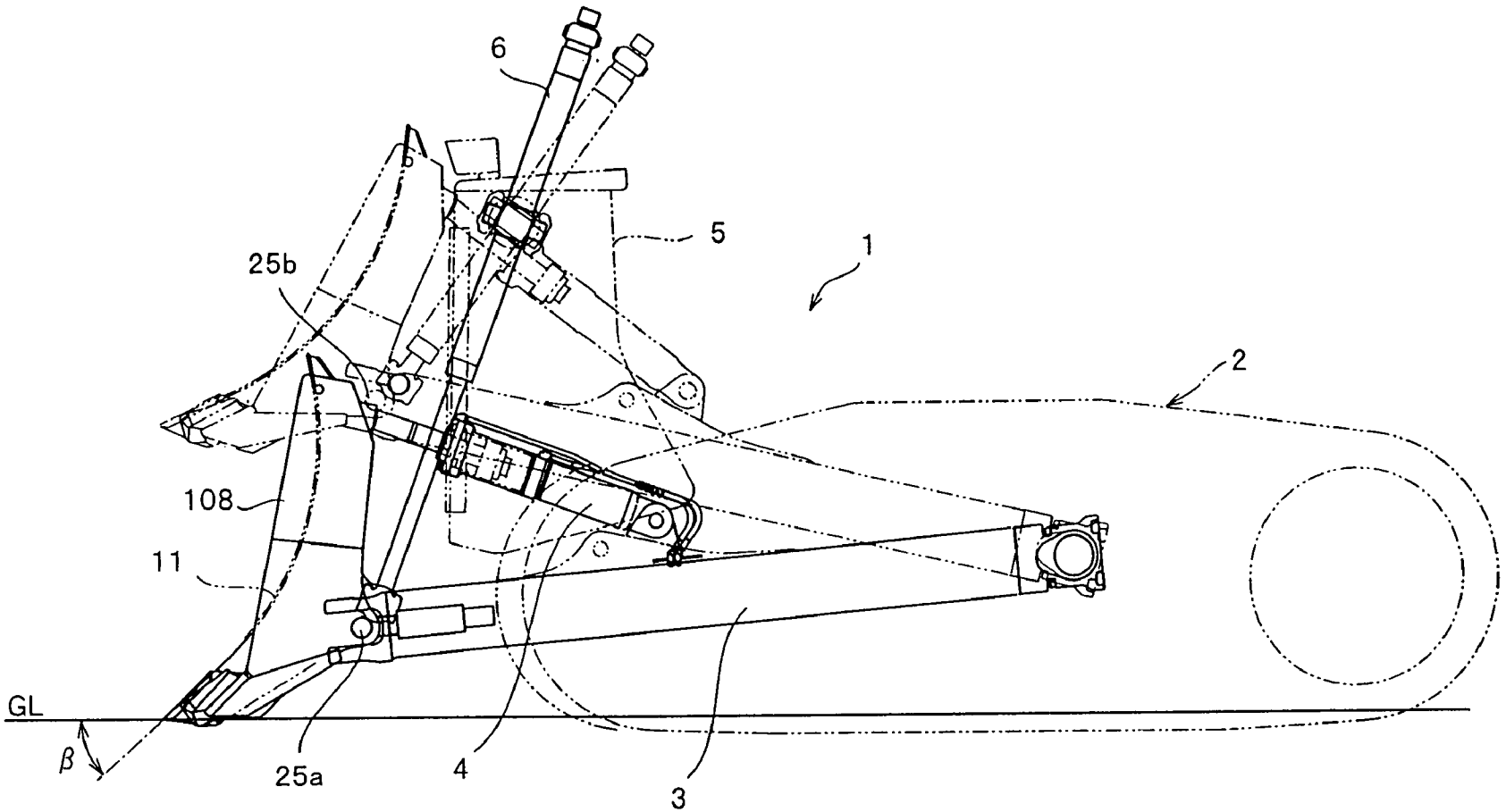
FIG. 4 is a side view showing an entire work machine for explaining up and down motion of the blade.

FIGS. 4 and 5 show an outline structure when the blade apparatus 10 of the embodiment is mounted on a bulldozer 1. The blade apparatus 10 is disposed on a front portion of the bulldozer 1. Front ends of a pair of lift frames 3 extending forward and each having base ends pivotally supported by a central portion of a crawler type running apparatus 2 and extends forward, a (hydraulic) tilt cylinder 4 extending forward and having a base end which is pivotally supported by a central portion of the lift frame 3, a (hydraulic) lift cylinder 6 whose one end is pivotally supported by a side wall of an engine room 5 disposed in a front portion of a driver's seat, a strut arm 7 diagonally extending toward a central portion of the back surface of the blade 11 and having a base end pivotally supported by the lift frame 3 as viewed from above are pivotally mounted. Therefore, a bracket for supporting the lift frame and the like are usually rearwardly projected from the back surface support member of the blade by welding. In this embodiment, as shown in FIGS. 4 and 5, in the pair of right and left integral castings 101, a first bracket 25*a* which supports a front end of the lift frame 3 is integrally cast and projected from an outer side lower end corner of the back surface support portion 103 of the integral casting 101 rearward. A second bracket 25*b* which supports a front end of the (hydraulic) tilt cylinder 4 is integrally cast on an upper portion of the bracket 25*a* of the back surface support portion 103 and projected rearward.

Figure 6:
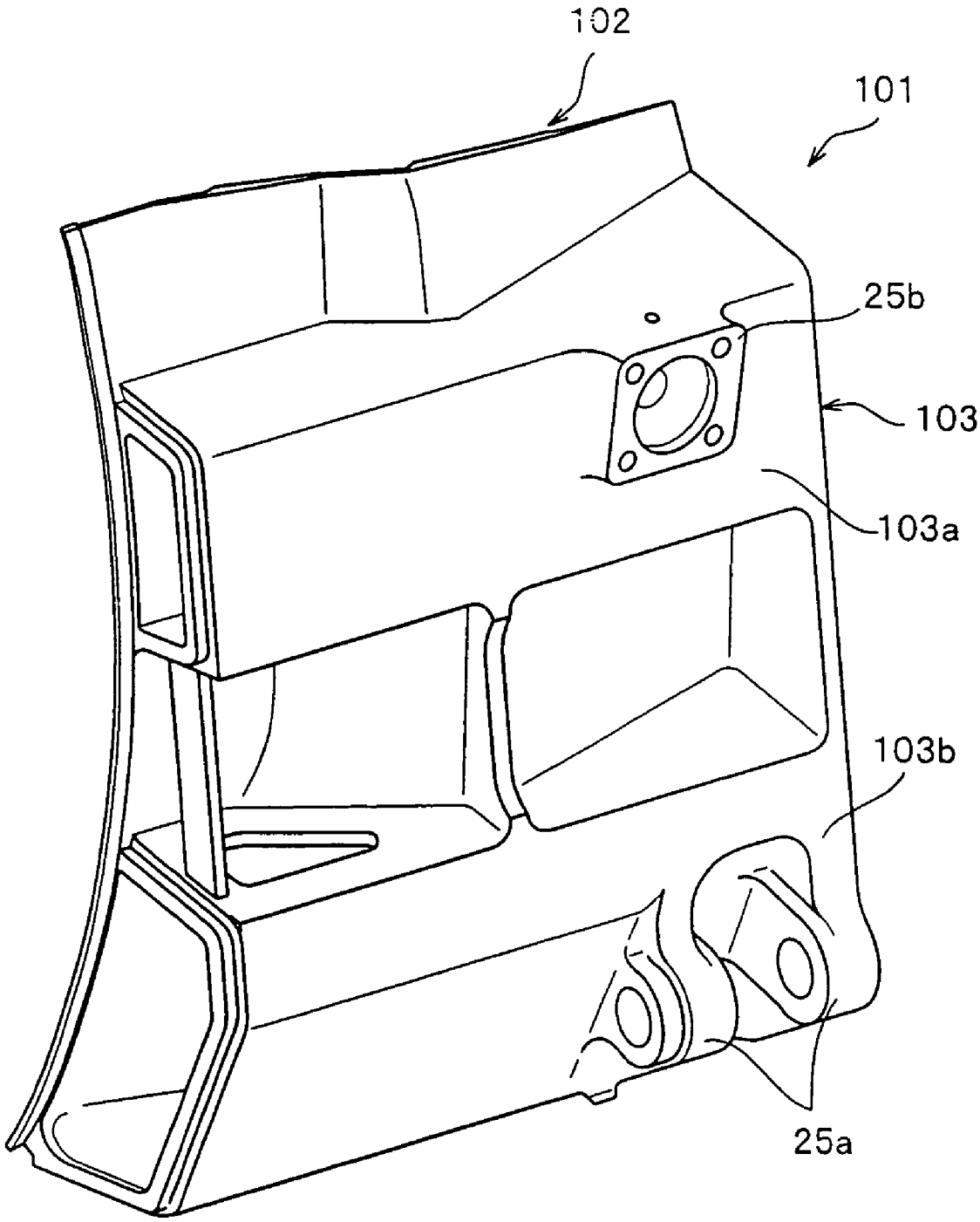
FIG. 6 is a perspective view of a left integral casting in the blade apparatus as viewed from left side of the back surface.
Figure 7:
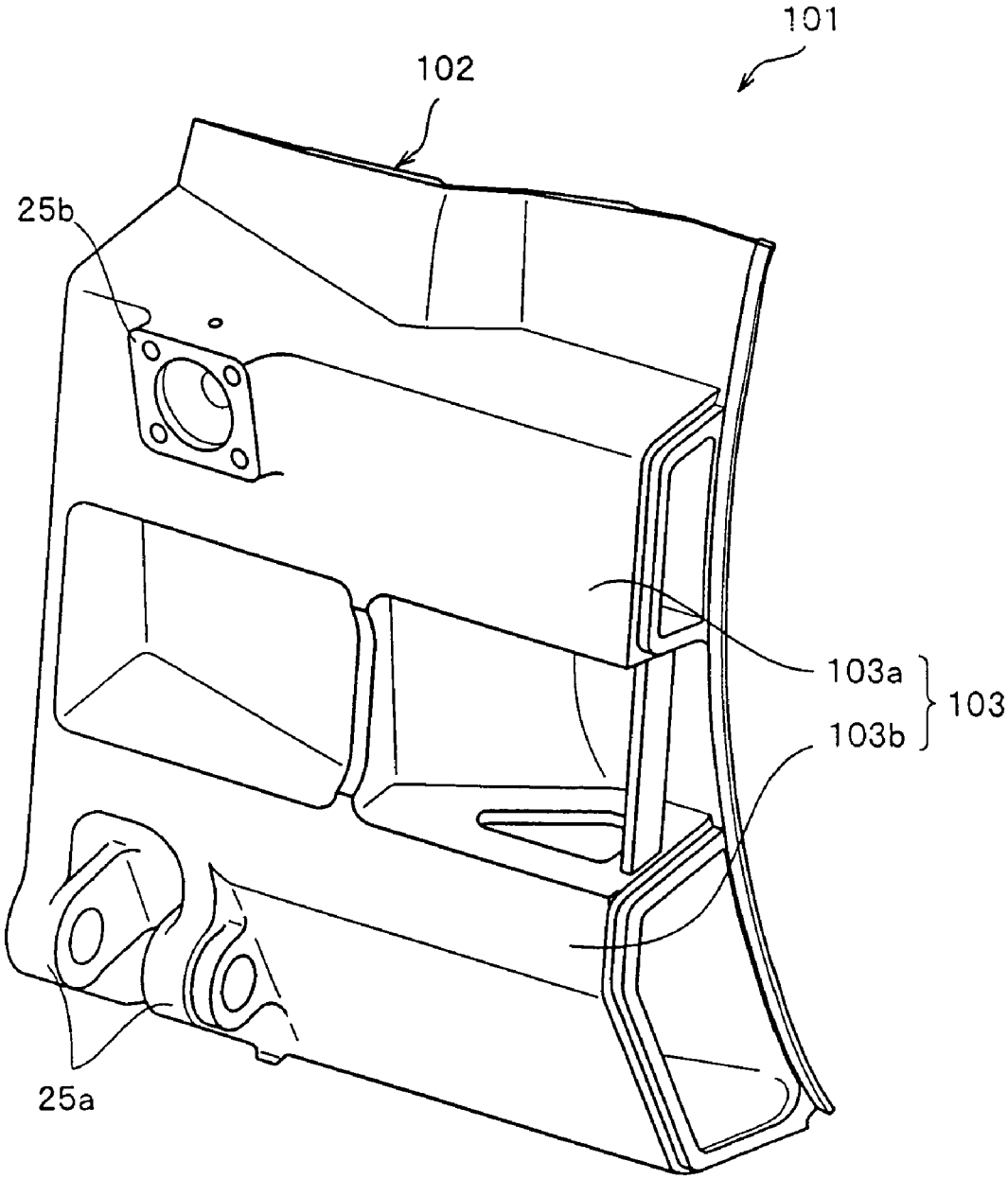
FIG. 7 is a perspective view of a right integral casting in the blade apparatus as viewed from right side of the back surface.

FIGS. 6 and 7 show the entire shape of the pair of right and left integral castings 101. As can be understood, the integral castings 101 are laterally symmetrically formed. The integral casting 101 of the embodiment includes the front surface plate portion 102 on the side of the front surface, and includes the back surface support portion 103 and the first and second brackets 25*a* and 25*b* on the back surface side. The thickness of the front surface plate portion 102 is equal over the entire portion. In the front surface plate portion 102, an end triangular portion of the central blade portion 12, and upper end edges of the bent coupled portion between the connection blade portion 13 and the end blade portion 14 are thicker than other portion to increase the rigidity and strength (see FIGS. 6 to 10).

As shown in FIGS. 6 and 7, laterally long rectangular cylindrical first and second back surface support portions 103*a* and 103*b* are rearwardly project from a central end of an upper portion and a lower end of the back surface support portion 105 of the integral casting 101 as viewed from behind. A portion between the back surface support portions 103*a* and 103*b* is reinforced by a columnar brace, and a hollow portions which are laterally in communication with each other is formed in the back surface support portions 103*a* and 103*b* to reduce its weight. A vertical cross section of the hollow portion is varied in accordance with the bent and coupled portion of the front surface plate portion 102. Especially at the casting position of the first bracket 25*a*, the cross section of the hollow portion is the smallest to secure the rigidity and strength.

Figure 8:
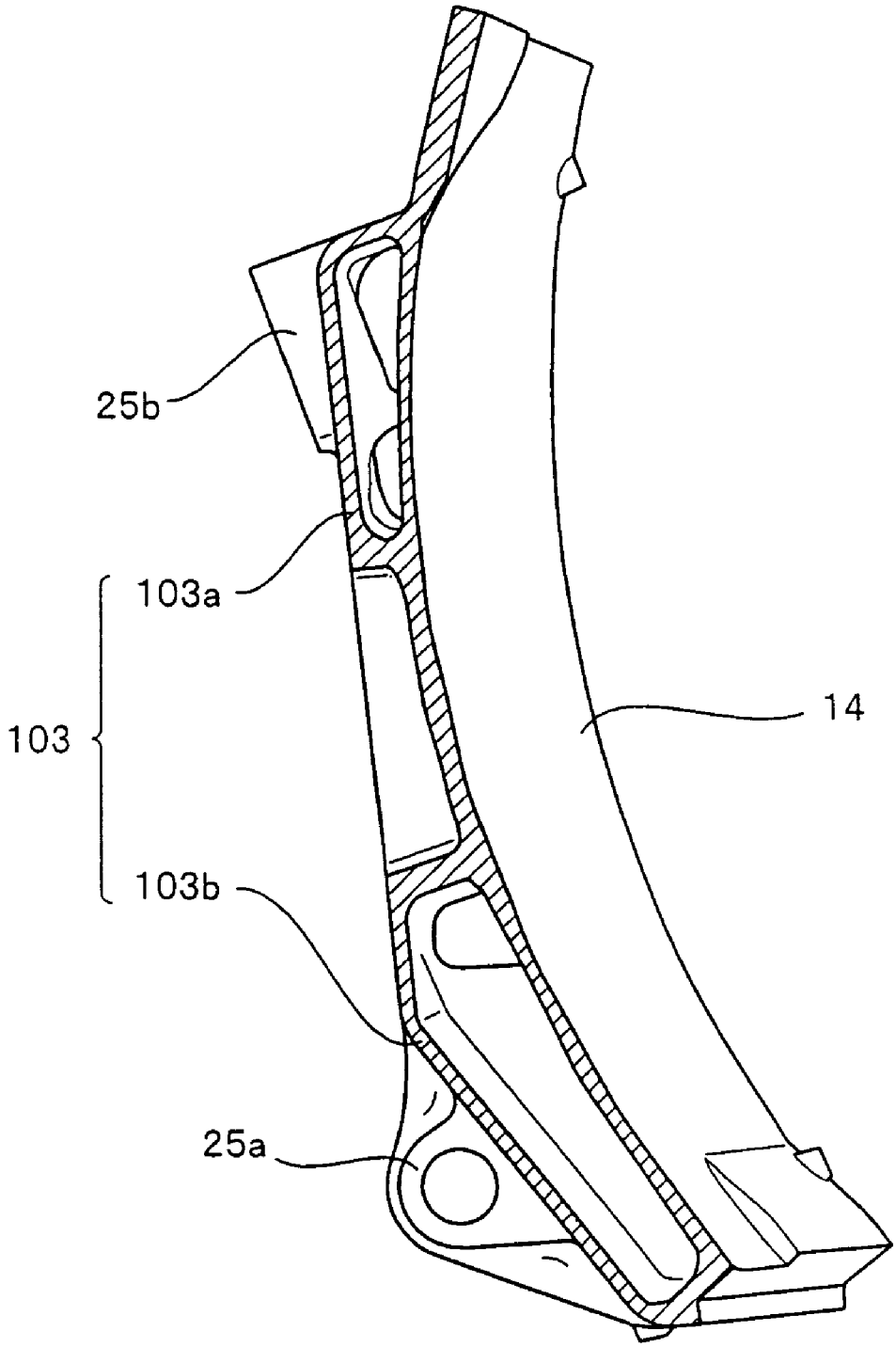
FIG. 8 is a sectional view taken along the line VIII-VIII in FIG. 2.
Figure 9:
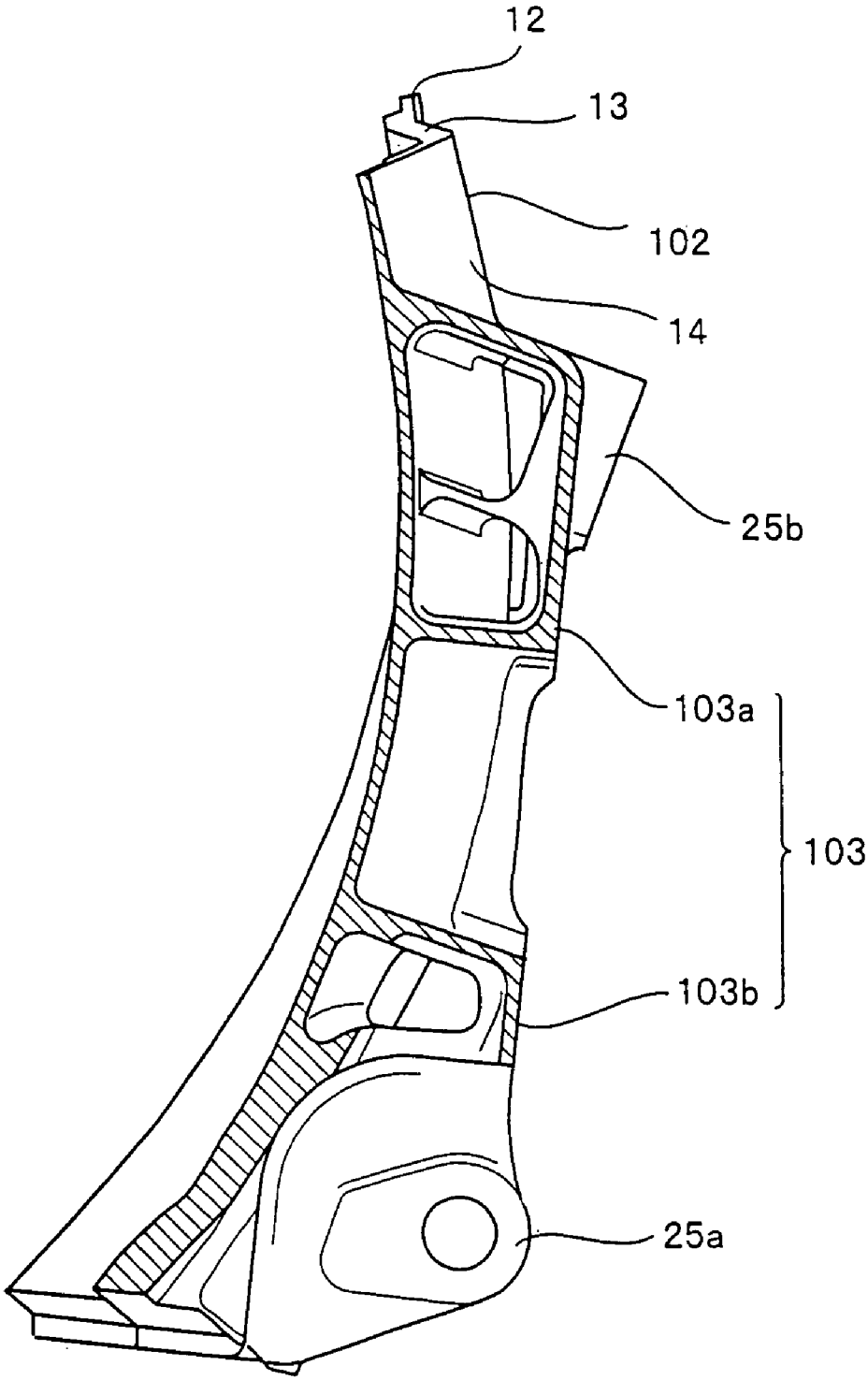
FIG. 9 is a sectional view taken along the line IX-IX in FIG. 3.
Figure 10:
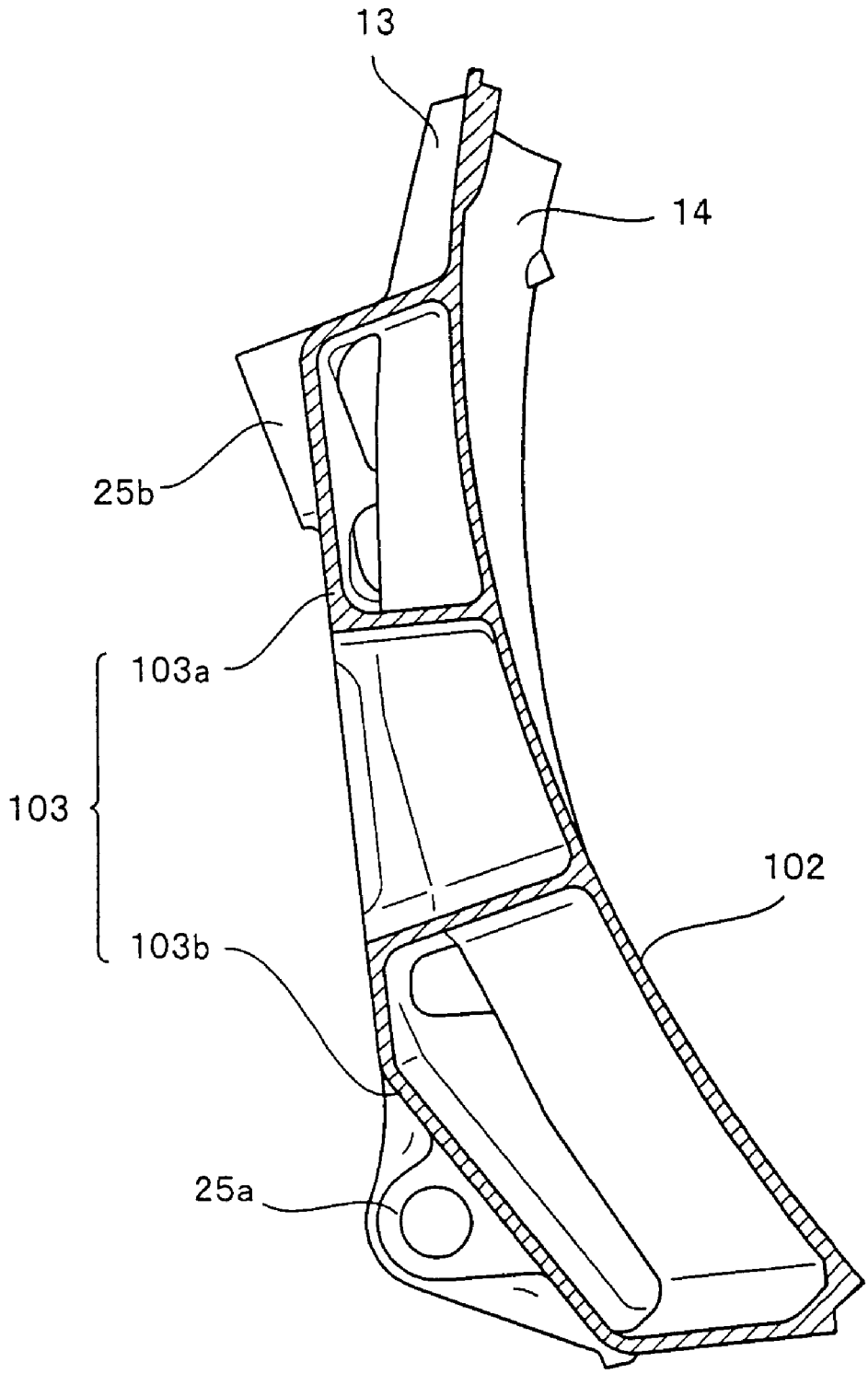
FIG. 10 is a sectional view taken along the line X-X in FIG. 3.
Figure 11:
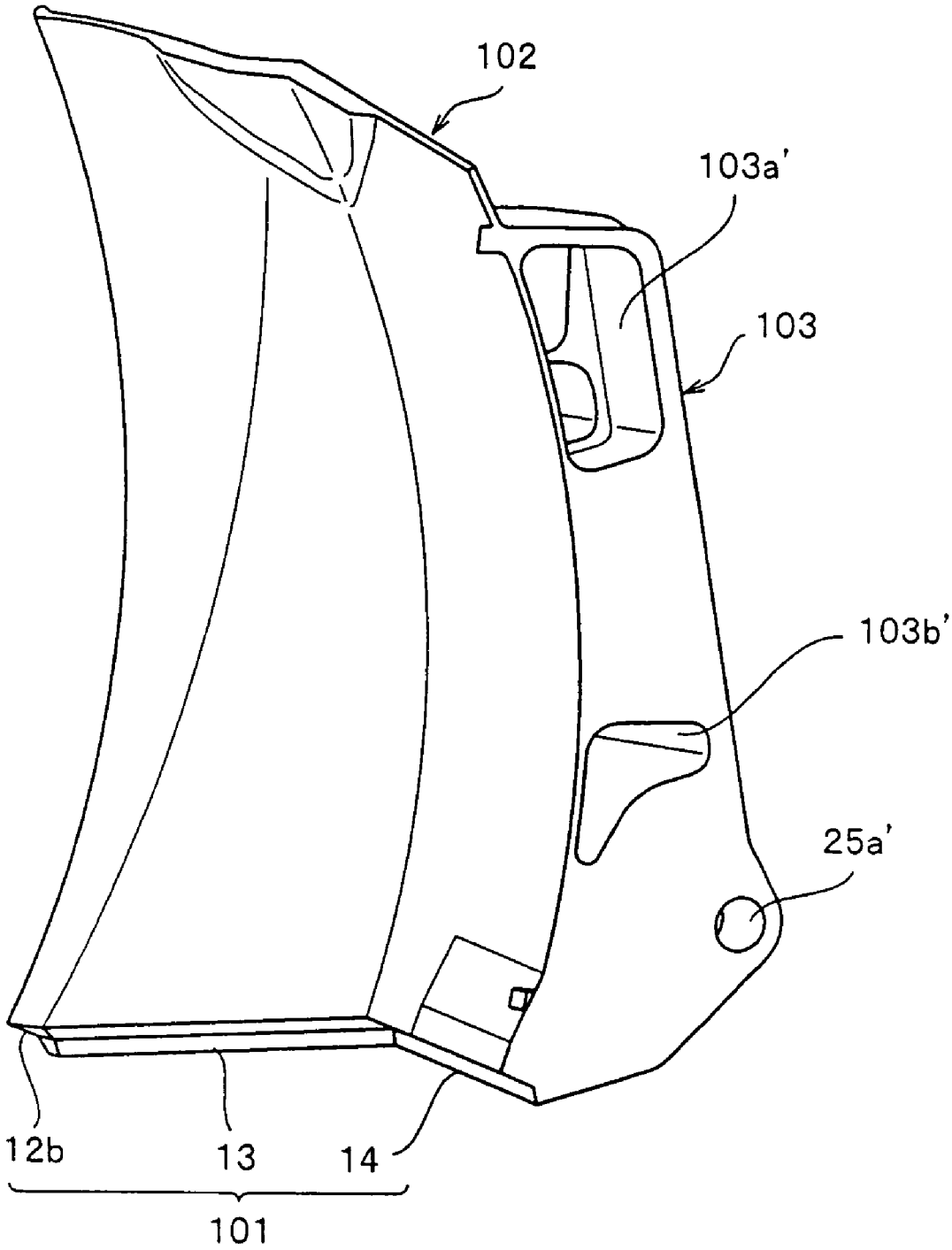
FIG. 11 is a perspective view of the right integral casting as viewed from right diagonally front thereof.

That is, FIG. 8 is a sectional view taken along the line of VIII-VIII in FIG. 2. This sectional view shows the cross section of the hollow portion along the bent line in the connection blade portion 13 and each front surface plate portion 102 of the end blade portion 14. FIG. 9 is a sectional view taken along the line of IX-IX in FIG. 3, and shows a cross section of the pair of right and left first brackets 25*a* taken along the vertical line passing through an intermediate portion thereof. FIG. 10 is a sectional view taken along the line X-X in FIG. 3, and shows a cross section of the casting closer to a boundary line between the integral casting 101 and the steel plate portion 105.

As can be understood from these drawings, a distance of the hollow portion between lower ends of the front surface plate portion 102 and the back surface support portions 103*a* and 103*b* is the shortest at the boundary portion between the connection blade portion 13 and the end blade portion 14, and a distance between lower ends of the front surface plate portion 102 of the right and left divided ends 12*b* and 12*b* of the central blade portion 12 in which a lower end of the front surface plate portion 102 projects forward most and the back surface support portions 103*a* and 103*b* is the longest. Each of the outer end surfaces of the right and left integral castings 101 is formed with a shaft hole 25*a*' of the first bracket 25*a* disposed outer side, an "L" shaped opening 103*b*', and a rectangular opening 103*a*' located above the former opening, and all of other portions are closed by predetermined thickness.

The steel plate portion 105 comprises a rectangular divided central region 12*a* of the central blade portion 12. As shown in FIGS. 2, 3 and 12 to 15, the steel plate portion 105 includes a front surface plate 106 obtained from one steel plate, a steel plate which is integrally formed on a back surface of the front surface plate 106 by welding, and a back surface support member 107 comprising a casting. As viewed from back of the blade apparatus 10 shown in FIG. 3, the back surface support member 107 comprises a first steel plate portion 107*a* made of flat and trapezoidal steel plate which is inclined and welded from an upper end edge of the blade apparatus 10 to an upper end edge of a cylindrical first back surface support portion 103*a* formed on an upper portion of the integral casting 101, a second back surface support member 107*b* which connects between cylindrical upper back surface support portions 103*a* of the pair of right and left integral castings 101 by welding with a central rectangular portion of the central blade portion 12 interposed therebetween, a third back surface support member 107*c* made of steel plate which closes, by welding, a space between the first back surface support portion 103*a* and the second back surface support portion 103*b* disposed below the first back surface support portion 103*a* across the right and left ends of the blade 11, and a fourth back surface support member 107*d* which connects, by welding, the right and left cylindrical second back surface support portions 103*b*.

Figure 3:
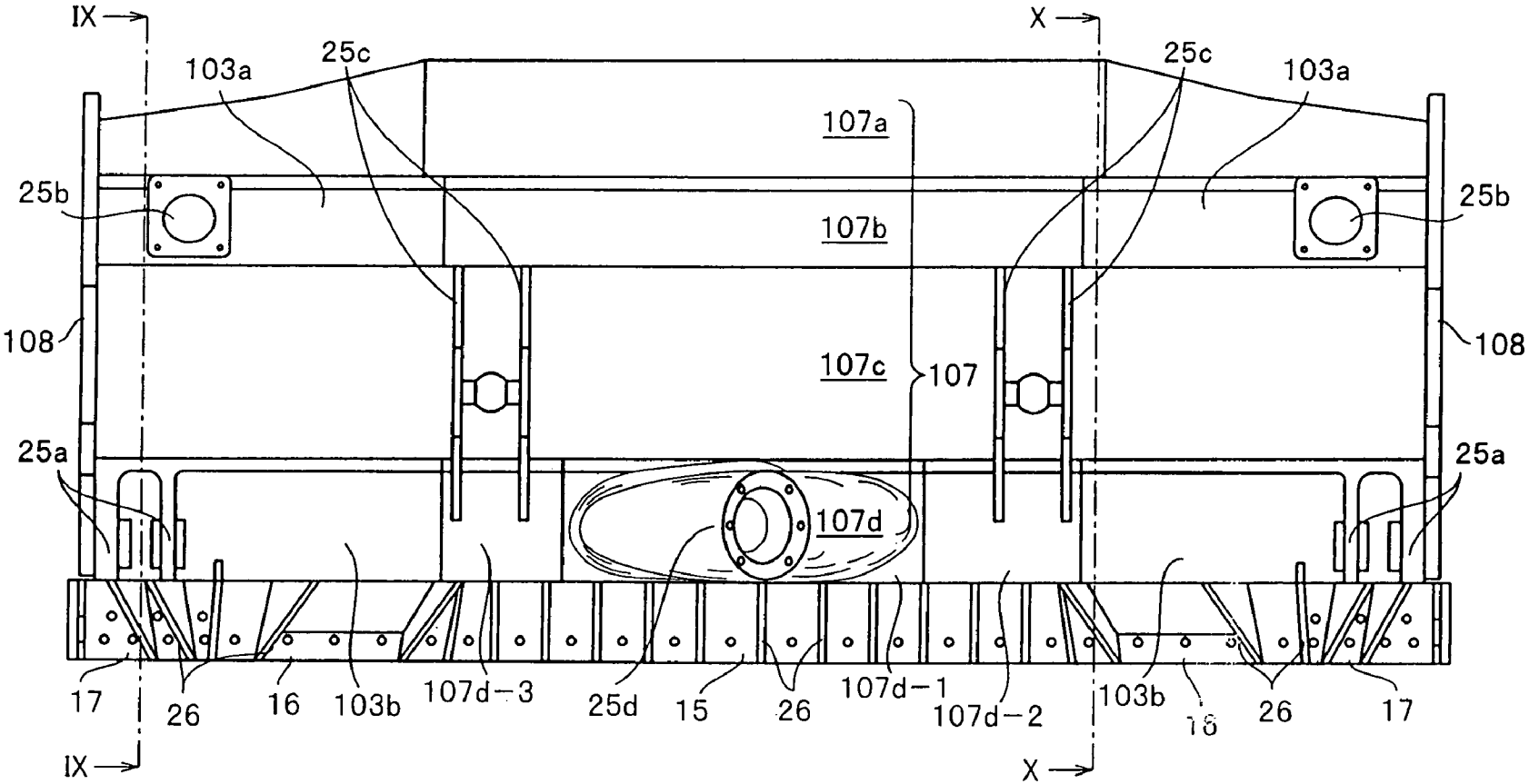
FIG. 3 is a rear view of the blade apparatus.
Figure 12:
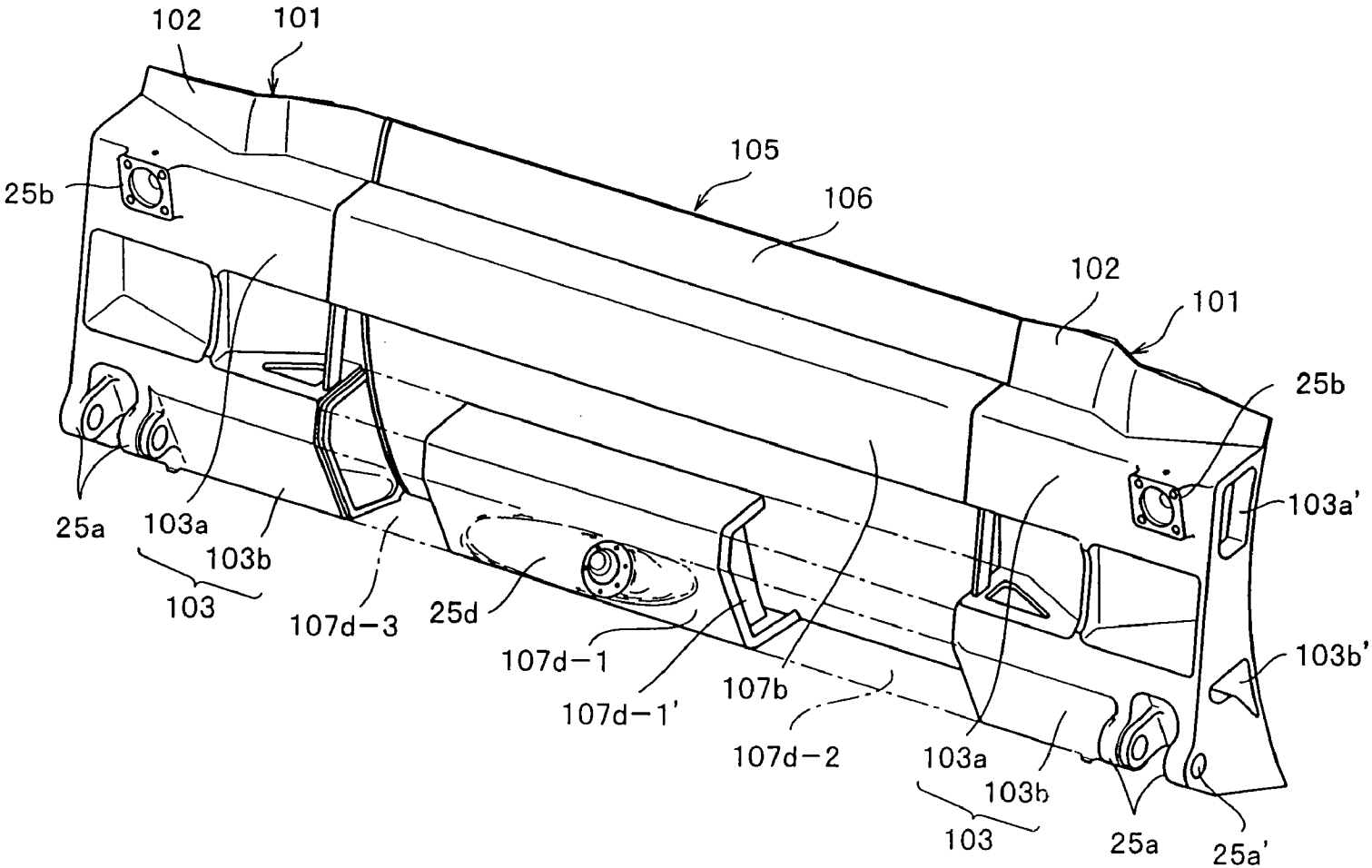
FIG. 12 is a perspective view of the blade apparatus as viewed from right diagonally rear direction on the side of the back surface thereof.
Figure 13:
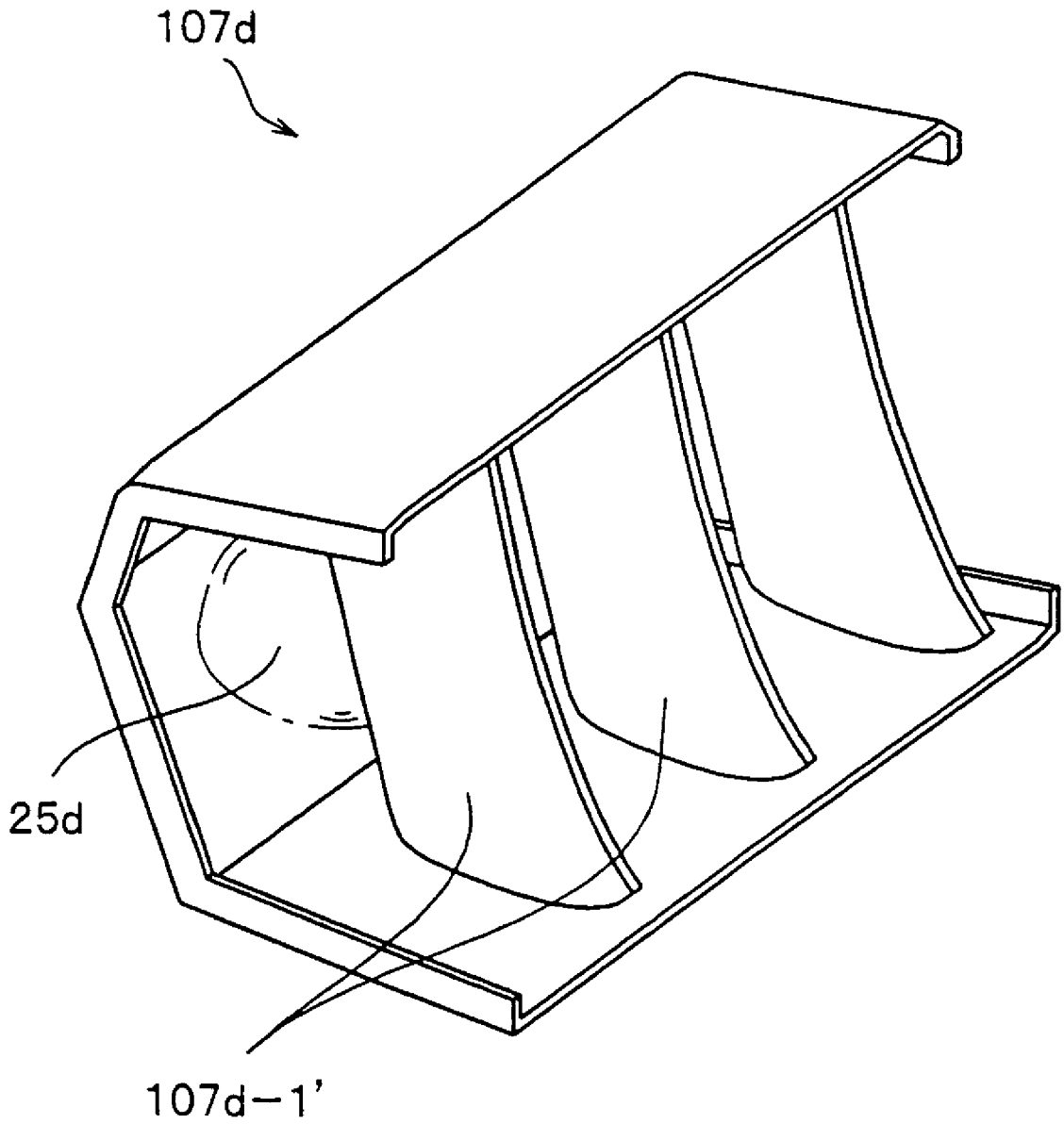
FIG. 13 is a perspective view of the back surface support member of the sheet metal portion as viewed from diagonally left side.
Figure 14:
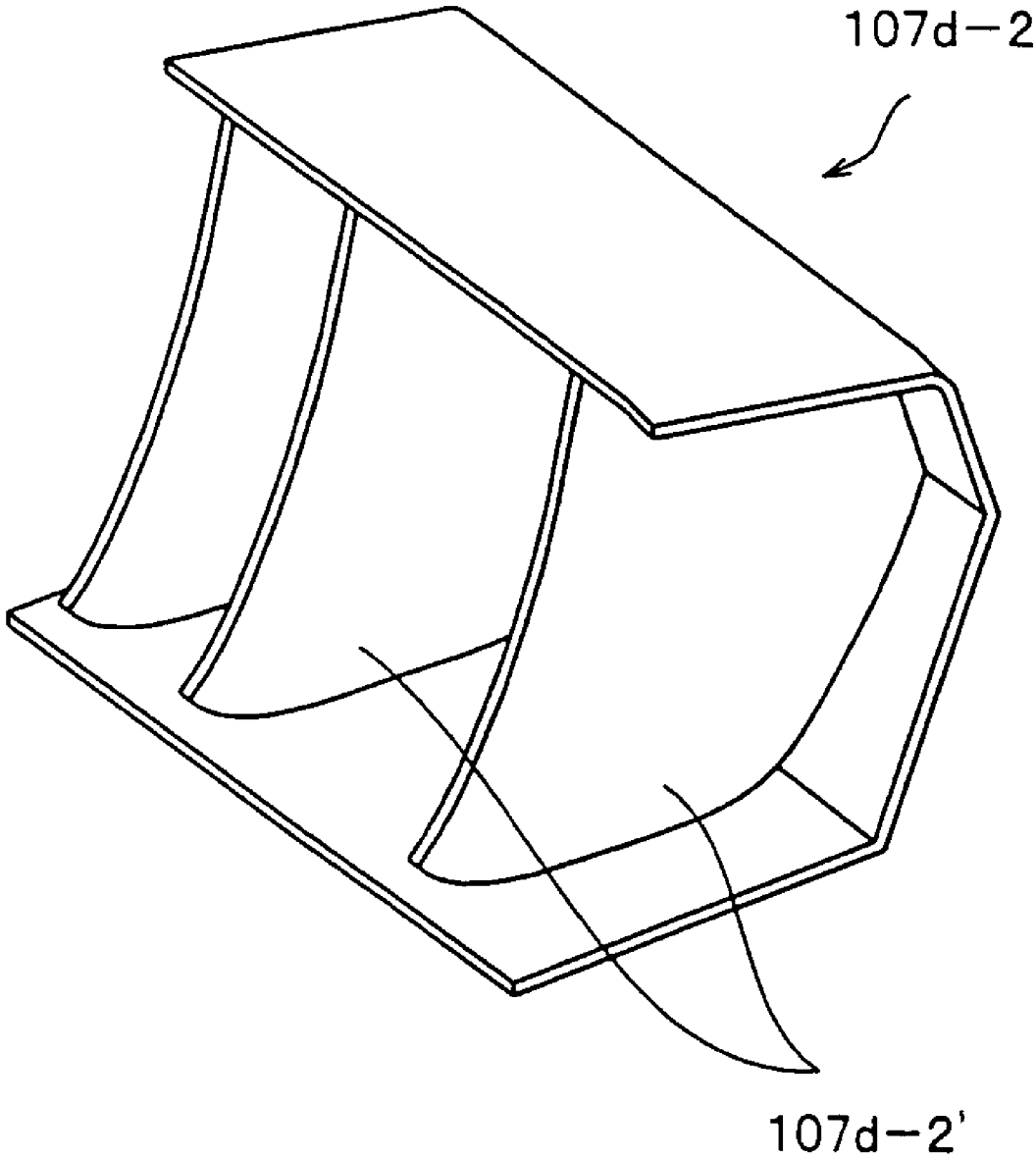
FIG. 14 is a perspective view of a portion of another back surface support member of the sheet metal portion as viewed from front.
Figure 15:
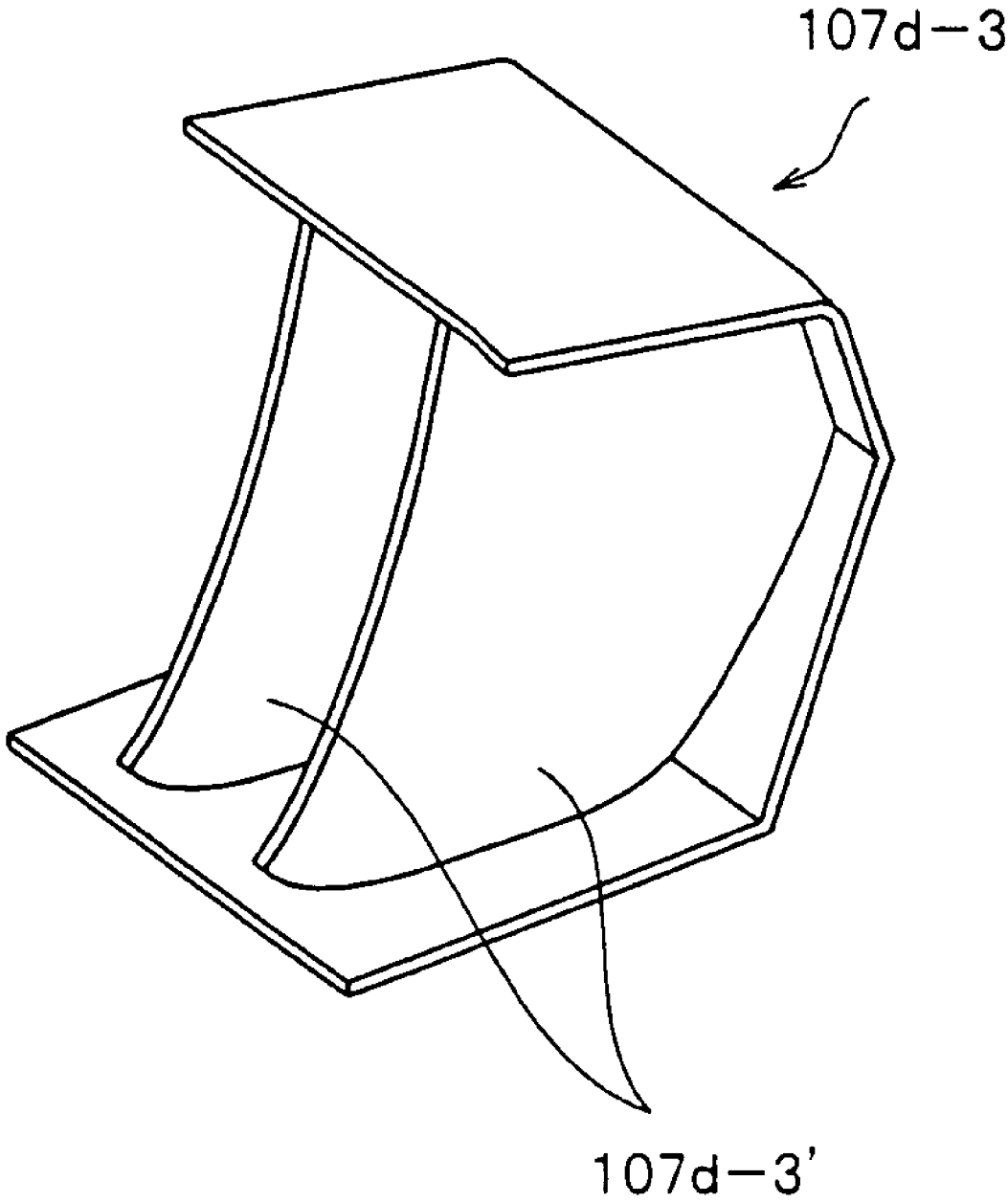
FIG. 15 is a perspective view of a portion of another back surface support member of the sheet metal portion as viewed from front.

The first and third back surface support members 107*a* and 107*c* are made of steel plate. A plurality of reinforcing ribs are interposed between the first and third back surface support members 107*a* and 107*c* and the front surface plate 106. The second back surface support member 107*b* is a U-shaped single casting having laterally long cross section. As shown in FIGS. 3 and 12, the fourth back surface support member 107*d* comprises a casting which is divided into three members, i.e., a left divided member 107*d*-1, a central divided member 107*d*-2 and a right divided member 107*d*-3. As shown in FIGS. 3 and 12, the central divided member 107*d*-2 is a block having U-shaped cross section, and a fourth bracket 25*d* is integrally cast such that the fourth bracket 25*d* rearwardly projects from a central portion of the central divided member 107*d*-2. The fourth bracket 25*d* supports one end of the Strut arm 7. A plurality of reinforcing ribs 107*d*-2' are cast between the inner wall surfaces. The divided members 107*d*-1 and 107*d*-3 disposed on right and left sides are also block bodies having U-shaped cross section including a plurality of reinforcing ribs 107*d*-1' and 107*d*-3' between the inner wall surfaces like the central divided member 107*d*-2.

The blade apparatus of the present invention having the above constituent members are assembled in the following manner:

First, inner end surfaces of the front surface plate portions of the pair of right and left integral castings 101, and right and left end surfaces of the rectangular front surface plate 106 of the central blade portion 12 are butted against each other, thereby integrally welding these three members.

Since the weld line at that time is on the vertical straight line as viewed from front, if the members are positioned, they can easily be welded by a welding robot. Before the welding operation, side plates 108 which have longitudinal widths extending forward from the curved front end of the outer end surfaces of the integral casting 101 are integrally formed on the outer side surfaces of the integral castings 101. The side plate 108 has function for holding the transported soil and prevent the soil from falling from the blade side, and for reinforcing the end blade portion 14.

The various back surface support members 107 are integrally assembled to the back surface of the blade 11 in succession. After the assembling operation is completed, the falcate third bracket 25*c* which supports two sets of right and left pairs of piston rod ends of the (hydraulic) lift cylinders 6 shown in FIGS. 3 and 4 are fixed between the right and left divided members 107*d*-1 and 107*d*-3 of the third back surface support member 107*c* and the fourth back surface support member 107*d* by welding. The first to third cutting edges 15 to 17 are fixed along lower ends of the central blade portion 12 of the blade 11 assembled in this manner, the connection blade portion 13 and the end blade portion 14 like the conventional blade, and the blade apparatus 10 of this invention is completed. The first cutting edge 15 is of flat and straight line shape along the lower end of the central blade portion 12. Thus, it is possible to effectively use the first cutting edge 15 for digging, transporting and leveling operations without exchanging the blade 11 for each of these operations, and each operation can be carried out smoothly and efficiently.

According to the blade apparatus 10 completed in this manner, the front surface plate 106 of the central blade portion 12, the end triangular portion of the central blade portion 12, the connection blade portion 13 and the end blade portion 14 can be assembled only by integrally forming the integral castings 101 which is integrally cast with the triangular divided end 12*b* of the central blade portion 12, the connection blade portion 13 and the end blade portion 14 on the right and left ends of the front surface plate 106 of the steel plate portion 105 which is a rectangular divided central region 12*a* of the central blade portion 12 by welding. At that time, since the cylindrical first and second back surface support portions 103*a* and 103*b*, and the first and second brackets 25*a* and 25*b* are integrally cast, the triangular divided end 12*b*, the connection blade portion 13 and the end blade portion 14 divided plate not require special working or assembling, and since the welding robot is employed, the assembling performance of the entire blade is enhanced, and the assembling time is largely shortened.

In the integral casting 101, the bent boundary portion between the connection blade portion 13 and the end blade portion 14 where the front surface plate portion 102 and the back surface support portion 103 approach each other most is shortened as small as possible. In the casting region of the first bracket 25*a* which pivotally supports the portion which requires rigidity and strength, especially the lift frame 3, the front surface plate portion 102 and the second back surface support portion 103*b* are cast as a continuous solid structure, and a portion between the front surface plate portion 102 in the other back surface region and the back surface support portions 103*a* and 103*b* is a hollow structure. Therefore, the longitudinal width of the blade apparatus 10 can be reduced to a minimum value, and its weight can be reduced. Especially, the first and second brackets 25*a* and 25*b* are integrally cast on the first and second back surface support portions 103*a* and 103*b*, its base end is pulled into the back surface support portion 103, and a rear projecting amount can be reduced and thus, the maximum longitudinal depth of the blade 11 can further be reduced. On the other hand, in a region of the back surface support member 107 of the steel plate portion 105 of the central blade portion 12 where high rigidity and strength are not required, a hollow structure using steel plate is employed, and a hollow structure having the reinforcing ribs 107*d*-1', 107*d*-2' and 107*d*-3' is employed for a region where high rigidity and strength are required. Thus, the rigidity and strength required for the entire blade can be secured, and the blade can be reduced in size and weight. Since the assembling performance is enhanced and the blade can be reduced in size and weight, cost can be reduced.

According to the blade apparatus 10 of the present invention, since it has the same blade front surface as that of the patent document 2 as described above, even in the embodiment also, the front surface of the connection blade portion 13 has function for allowing soil transferred from both front surfaces of the central blade portion 12 and the end blade portion 14 to smoothly merge at the time of digging and transporting. The end blade portion 14 has function for reliably hold soil during the digging and transporting such that the soil does not overflow from the blade side. Since the connection blade portion 13 and the end blade portion 14 hold soil such as to heap up the soil along each blade front surface, the amount of soil loss is reduced, resistance of soil trying to flow from the end blade portion 14 toward the central blade portion 12 is reduced, and the amount of soil accumulated on the blade front surface of the central blade portion 12 can largely be increased.

The first cutting edge 15, the second cutting edge 16 and the third cutting edge 17 are made of strong material having excellent wear resistance which is not damaged easily, i.e., boron steel. If the first cutting edge 15, the second cutting edge 16 and the third cutting edge 17 are disposed as described above, the first cutting edge 15 excavates earlier than the second cutting edge 16 and the third cutting edge 17. Since the first cutting edge 15 excavates its peripheral ground, the digging force required for the second cutting edge 16 and the third cutting edge 17 is set smaller than that of the first cutting edge 15, and the second cutting edge 16 and the third cutting edge 17 excavate smaller amount of soil than the first cutting edge 15. A plurality of vertical plate ribs 26 . . . for reinforcing the cutting edges 15 to 17 longitudinally extend from a portion corresponding to the first to third cutting edges 15 to 17 of the lower end plate of the blade 11 as shown in FIG. 3, and front ends of the vertical plate ribs 26 . . . and rear surfaces of the cutting edges 15 to 17 are threadedly engaged with each other.

The intersection angle θ shown in FIG. 5 at which extensions of the cutting edges 15 and 17 of the central blade portion 12 and the end blade portion 14 intersect with each other is set to 16°. If the intersection angle θ is set greater than 25°, the resistance of soil moving from the end blade portion 14 to the connection blade portion 13 becomes small, and natural heap mode and holding mode exceeding the angle of repose along the blade front surfaces of the front surface portions 12 to 14 can not be obtained. Thus, it is preferable that the intersection angle θ is set to 25° or smaller, and optimal soil amount placed on the blade front surfaces of the connection blade portion 13 and the end blade portion 14 can be secured, and it is preferable that the intersection angle θ is set in a range of 10 to 20°.

In each of the blade portions 12 to 14, the blade front surface of at least the central blade portion 12 is inclined rearward (pitch back) as compared with the front surface of the first cutting edge 15. In the illustrated example, like the blade apparatus of the patent document 2, a rewardingly inclined angle γ which is a difference between an angle (blade edge angle) α formed between the ground and the front surface of the first cutting edge 15 and an angle (digging angle) β formed between the ground and the blade lower end surface of the central blade portion 12 is set to 10° (see FIG. 16). If the rewardingly inclined angle is set to 15° or smaller, it is possible to reduce the rearward soil overflow of the blade portions 12 to 14 can be reduced at the time of the digging and transporting.

Figure 17:
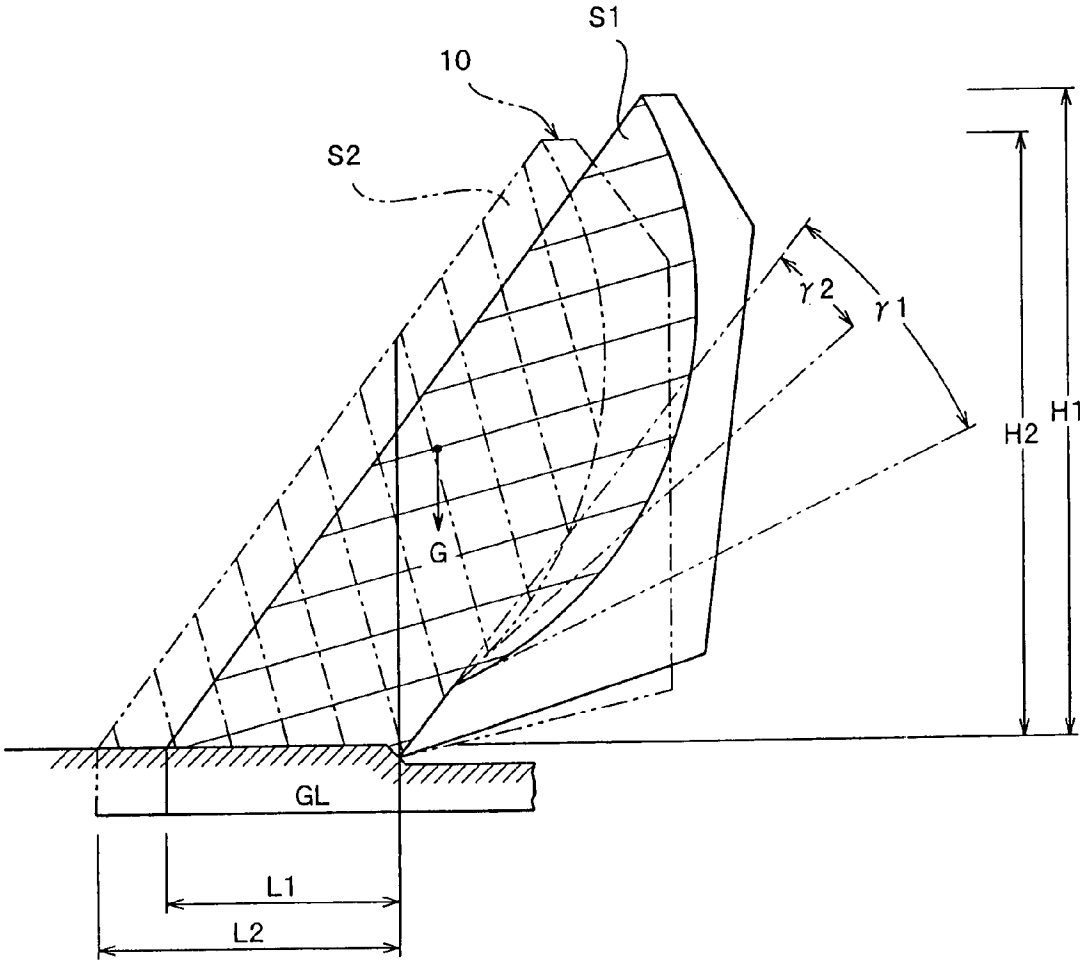
FIG. 17 is an explanatory view showing the relation soil accumulated on a front portion of the blade between a normal attitude of the blade and a rearwardly inclined (pitch back) attitude at the time of digging and transporting.

In order to reduce the sliding resistance between the ground and soil accumulated on the ground in a front portion of the blade at the time of the transporting operation, the mount of soil accumulated on the ground should be reduced. As shown with solid lines and phantom lines in FIG. 17, the angle of repose of the front surface of the accumulated soil when it is carried by the blade is constant. In order to reduce the amount of soil accumulated on the ground, the end of soil is brought close to the blade edge of the blade apparatus 10 as close as possible such that a distance between the blade edge and the end of soil accumulated on the ground becomes equal to L1 from L2, and a hatch region by the leftward lowering inclination line of shown with the solid lines and phantom lines in the drawing is shifted from S2 to S1. FIG. 17 is an explanatory view for schematically explaining variation of the sliding resistance between the ground and soil accumulated on the ground in the front portion of the blade based on the blade attitude. In FIG. 17, the solid lines show transporting attitude of the blade apparatus 10 of the present invention, the phantom lines show the transporting of a normal blade. Here, the front surface curved surfaces of both blades are the same, and the digging angle β is constant.

If the attempt is made to bring the end of soil accumulated on the ground close to the blade edge, since the front surface of soil accumulated on the ground always form he same inclination angle, if the digging angle β and the rewardingly inclined angle γ are set constant, the height of the blade is reduced naturally, and the holding amount of soil accumulated on the blade is also reduced. In order to set the holding amount equal to the normal value, since the blade width is constant, it is necessary that the regions S1 and S2 shown with right inclining hatches by the solid lines and phantom lines are the same.

Figure 16:
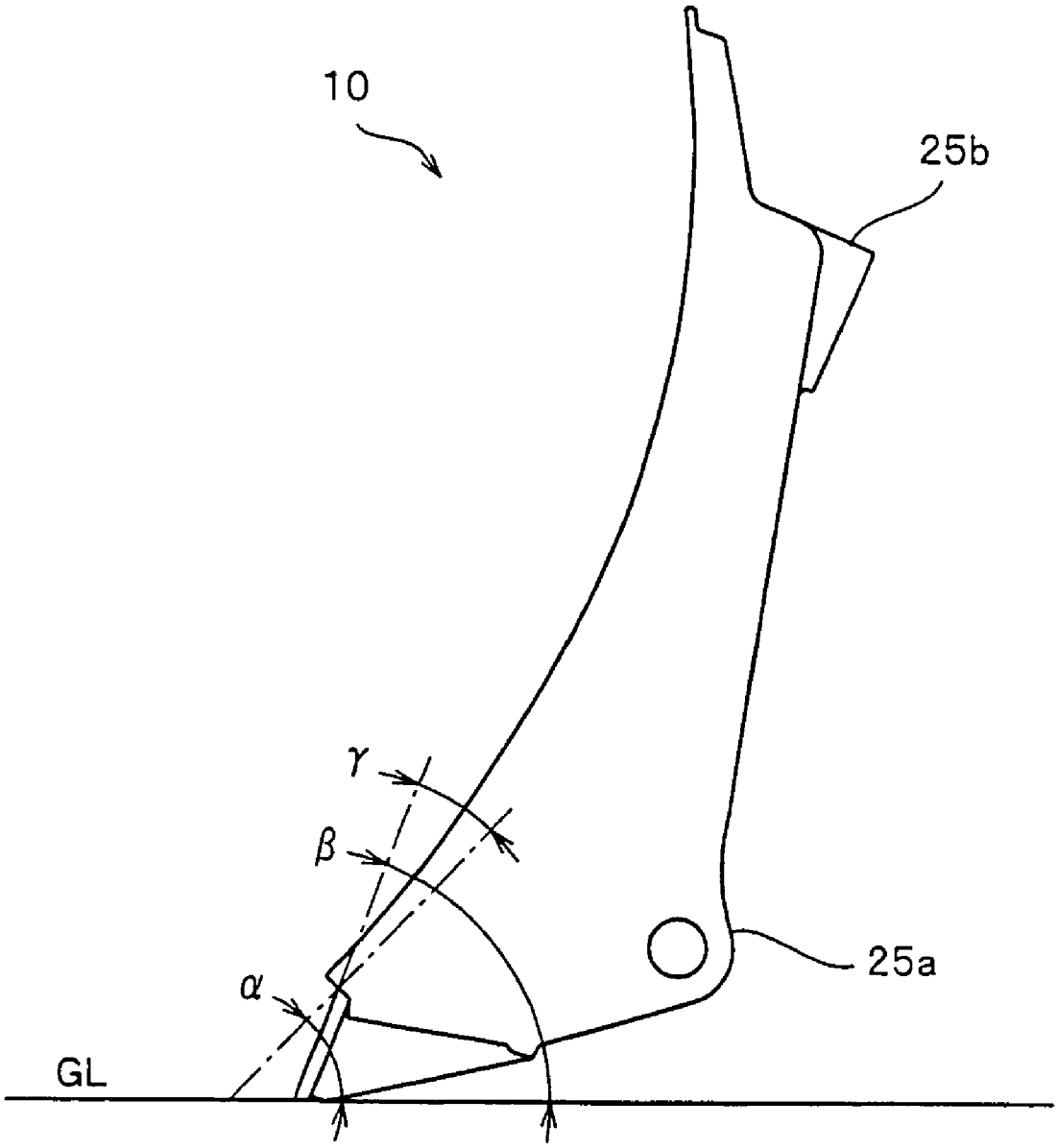
FIG. 16 is a view showing the relation of an intersection angle between a cutting edge and a curved surface in a front surface of a blade portion.

As a result, in order to reduce the transporting resistance and to set the digging amount and transporting amount are set to the normal values, the blade edge angle α is adjusted, the blade apparatus 10 is inclined rearward (pitch back) and the height of the blade is increased without changing the digging angle β as shown with solid lines in FIG. 16. That is, if the rewardingly inclined angle γ which is a difference between the digging angle β and the blade edge angle α is set to a retreated angle which is greater than the normal rewardingly inclined angle γ, the blade apparatus 10 can be inclined rearward. However, if the rewardingly inclined angle γ is excessively increased, the rearward overflowing amount of soil from the blade is increased, and the accumulated soil does not drop from the blade apparatus 10 easily. Thus, it is preferable that the rewardingly inclined angle is 15° or smaller as described above.

In this embodiment also, the rewardingly inclined angle is 10°, a grounding length L1 of the accumulated soil of the blade apparatus 10 in this embodiment is reduced by about 10% as compared with a grounding length L2 of the normal accumulated soil accumulated on the ground in the front portion of the blade edge at that time, and the accumulated soil on the ground is largely reduced. A large amount of accumulated soil in front portions of the blade portions 12 to 14 during the digging and transporting can be carried, and the so-called holding amount is increased. As a result, the transporting resistance can largely be reduced and thus, the consumed horsepower per tractional force can largely be reduced, and excellent fuel economy can be obtained.

Since the large amount of soil can be carried on the front surface of the blade 11 as described above, the longitudinal ground pressure of the vehicle body is well balanced, power loss such as shoe slip is reduced, and high tractional force can be obtained. The soil accumulated on the blade front surface of the blade 11 is prevented from exceeding the upper ends of the blade portions 12 to 14 and overflowing rearward. The excavated soil is not brought into contact with the blade front surface under pressure, and soil separates excellently at the time of discharging operation of soil, and discharging operation of soil is enhanced. The blade edge angle $\alpha$ formed between the ground and the front surface when the cutting blades of the cutting edges 15 to 17 are on the ground is preferably 35° or larger. With this, minimum digging, transporting energy amounts and maximum soil amount are effectively obtained.

The tractional force caused by the blade of the present invention and the amount of soil per tractional force are increased as compared with the conventional blade. According to the blade of the present invention, the digging resistance is smaller than that of the conventional blade, and the transporting resistance is also smaller. Thus, the consumed horsepower at the time of digging and transporting in the blade of the present invention is smaller than that of the conventional blade at the time of digging and transporting. From the above points, the blade of the present invention can realize desired dozer operation efficiently with shorter operation time and smaller tractional force and smaller digging force as compared with the conventional blade.

As is apparent from the above explanation, since the blade of the blade apparatus of the invention is formed by effectively combining the integral casting and the steel plate, the blade structure is simplified, the assembling operation and welding operation are facilitated, and the blade is reduced in size and weight. The resistance force against the tractional force described in the patent document 2 is reduced, and the amount of soil per tractional force is largely increased. The consumed horsepower during the digging and transporting can largely be reduced, the maximum digging amount and transporting amount can be obtained within short time with minimum energy, the fuel economy efficiency of the work machine is remarkably enhanced, and the cost is reduced.

What is claimed is:

1. A blade apparatus for a work machine, the blade apparatus mounted on various work machines, wherein the blade apparatus comprises:

a central front surface portion, and a connecting front surface portion, and end front surface portions, each of which are bent and continuously provided on each of right and left ends of the central front surface portion in succession;

the central front surface portion has a blade width whose lower end intersects with a digging direction and extends laterally, and is provided at a further lower end of said lower end with a first cutting edge;

the connecting front surface portion is disposed on each of the right and left ends of the central front surface portion, and a second cutting edge provided at a lower end of the connecting front surface portion;

the end front surface portion is continuously formed on the connecting front surface portion and is provided at its lower end with a third cutting edge;

a cross line between the connecting front surface portion and the end front surface portion and a cross point between blade edges of the second cutting edge and the third cutting edge are located on retreat positions rearward of a blade edge of the first cutting edge as viewed from above;

respective front surfaces of the central front surface portion, the connecting front surface portion and the end front surface portion have a central blade portion formed on vertically continuous concave curved surfaces and an end blade portion which is continuously formed on each of right and left ends of the central blade portion through a connection blade portion; and a blade that comprises:

a pair of right and left integral castings which include at least all of the connection blade portion and the end blade portions, and a region of right and left connecting side end portion of the central blade portion;

a plate portion including at least a main region which excludes the region of right and left connecting side end portion of the central blade portion, and having a connection end surface connected to a connection end surface of the integral casting, and a connection line between the each connecting end surface of the integral casting and the each connecting end surface of the plate portion is located on a vertical straight line as viewed from front, wherein a back surface support member is disposed on a back surface of the plate portions such that the back surface support member and the back surface of the integral casting are flush with respect to each other.

2. The blade apparatus for the work machine according to claim 1, wherein brackets which pivotally support ends of right and left lift frames and various hydraulic cylinders are integrally cast on a back surface portion of the integral casting.

3. The blade apparatus for the work machine according to claim 2, wherein a blade portion on which a maximum load of the integral casting is applied and the back surface portion are formed into at least a continuous solid structure.

4. The blade apparatus for the work machine according to claim 1, wherein a plurality of reinforcing ribs are disposed between at least a portion of the plate portion and at least a portion of the back surface support member.

5. The blade apparatus for the work machine according to claim 4, wherein at least a portion of the back surface support member and the plurality of reinforcing ribs are formed as an integral casting.

6. The blade apparatus for the work machine of claim 1, wherein respective blade portion front surfaces of the central blade portion, the connection blade portion and the end blade portion are vertically continuous concave curved surfaces having a same curvature.

7. The blade apparatus for the work machine of claim 1, wherein the central blade portion, the connection blade portion and the end blade portion are continuously formed into a V-shape or a U-shape, respectively.

8. A work machine comprising a blade apparatus, wherein the blade apparatus comprises:

a central front surface portion, and a connecting front surface portion, and end front surface portions, each of which are bent and continuously provided on each of right and left ends of the central front surface portion in succession;

the central front surface portion has a blade width whose lower end intersects with a digging direction and extends laterally, and is provided at a further lower end of said lower end with a first cutting edge;

the connecting front surface portion is disposed on each of the right and left ends of the central front surface portion, and a second cutting edge provided at a lower end of the connecting front surface portion;

the end front surface portion is continuously formed on the connecting front surface portion and is provided at its lower end with a third cutting edge;

a cross line between the connecting front surface portion and the end front surface portion and a cross point between blade edges of the second cutting edge and the third cutting edge are located on retreat positions rearward of a blade edge of the first cutting edge as viewed from above;

respective front surfaces of the central front surface portion, the connecting front surface portion and the end front surface portion have a central blade portion formed on vertically continuous concave curved surfaces and an end blade portion which is continuously formed on each of right and left ends of the central blade portion through a connection blade portion; and a blade that comprises:

a pair of right and left integral castings which include at least all of the connection blade portion and the end blade portions, and a region of right and left connecting side end portion of the central blade portion a plate portion including at least a main region which excludes the region of right and left connecting side end portion of the central blade portion, and having a connection end surface connected to a connection end surface of the integral casting, and a connection line between the each connecting end surface of the integral casting and the each connecting end surface of the plate portion is located on a vertical straight line as viewed from front, wherein a back surface support member is disposed on a back surface of the plate portions such that the back surface support member and the back surface of the integral casting are flush with respect to each other.

9. The work machine according to claim 8, wherein brackets which pivotally support ends of right and left lift frames and various hydraulic cylinders are integrally cast on a back surface portion of the integral casting.

10. The work machine according to claim 9, wherein a blade portion on which a maximum load of the integral casting is applied and the back surface portion are formed into at least a continuous solid structure.

11. The work machine according to claim 8, wherein a plurality of reinforcing ribs are disposed between at least a portion of the plate portion and at least a portion of the back surface support member.

12. The work machine according to claim 11, wherein at least a portion of the back surface support member and the plurality of reinforcing ribs are formed as an integral casting.

13. The work machine according to claim 8, wherein respective blade portion front surfaces of the central blade portion, the connection blade portion and the end blade portion are vertically continuous concave curved surfaces having a same curvature.

14. The work machine according to claim 8, wherein the central blade portion, the connection blade portion and the end blade portion are continuously formed into a V-shape or a U-shape, respectively.

15. A blade included in a blade apparatus for a work machine, the blade comprising:

a pair of right and left integral castings which include:

a connection blade portion, end blade portions, wherein an end blade portion is continuously formed on each of right and left ends of a central blade portion that is formed on vertically continuous concave curved surfaces through the connection blade portion, and a region of right and left connecting side end portion of the central blade portion;

a plate portion including:

a main region which excludes a region of right and left connecting side end portion of the central blade portion, and a connection end surface connected to a connection end surface of the integral casting; and a connection line between each connecting end surface of the integral casting and each connecting end surface of the plate portion, wherein the connection line is located on a vertical straight line as viewed from front, and wherein a back surface support member is disposed on a back surface of the plate portion such that the back surface support member and the back surface of the integral casting are flush with respect to each other, wherein the blade apparatus includes:

a central front surface portion, a connecting front surface portion, and end front surface portions, each of which are bent and continuously provided on each of right and left ends of the central front surface portion in succession, wherein the central front surface portion has a blade width whose lower end intersects with a digging direction and extends laterally, and is provided at a further lower end of the lower end with a first cutting edge, the end front surface portion is continuously formed on the connecting front surface portion and is provided at its lower end with a third cutting edge, and a cross line between the connecting front surface portion and the end front surface portion and a cross point between blade edges of the second cutting edge and the third cutting edge are located on retreat positions rearward of a blade edge of the first cutting edge as viewed from above, and wherein the central blade portion has respective front surfaces of the central front surface portion, the connecting front surface portion and the end front surface portion.

* * * * *